US005778273A

United States Patent [19]

Ben-Yaacov

[11] Patent Number: 5,778,273

[45] Date of Patent: Jul. 7, 1998

[54] PHOTOGRAPHIC PROCESSING SYSTEM

[76] Inventor: Shlomo Ben-Yaacov, 51 Lispenard St., New York, N.Y. 10013

[21] Appl. No.: 716,797

[22] Filed: Sep. 16, 1996

Related U.S. Application Data

[63] Continuation-in-part of Ser. No. 348,981, Nov. 28, 1994, Pat. No. 5,579,073.

[51] Int. Cl.[6] ..... G03D 17/00

[52] U.S. Cl. ..... 396/598; 596/589; 596/652; 596/647

[58] Field of Search ..... 396/590, 589, 396/591, 598, 626, 641, 636, 652, 3, 647; 355/27–29

[56] References Cited

U.S. PATENT DOCUMENTS

| | | | |
|---|---|---|---|
| 624,111 | 5/1899 | Snow | 396/3 |
| 1,348,153 | 8/1920 | Core . | |
| 1,725,010 | 8/1929 | Menon . | |
| 2,909,979 | 10/1959 | Corrons . | |
| 3,208,335 | 9/1965 | Doherty . | |
| 3,524,396 | 8/1970 | Blinoff | 396/612 |
| 3,703,860 | 11/1972 | Wilkinson | 95/93 |
| 3,884,149 | 5/1975 | Shores | 101/450 |
| 4,185,912 | 1/1980 | Schwartz | 355/28 |
| 4,268,156 | 5/1981 | Kostiner | 354/324 |
| 4,340,293 | 7/1982 | Russotti | 396/3 |
| 4,575,209 | 3/1986 | Zwettler | 354/322 |
| 5,450,155 | 9/1995 | Carmen | 354/331 |

FOREIGN PATENT DOCUMENTS

| | | |
|---|---|---|
| 127546 | 3/1932 | Australia . |
| 2527560 | 1/1977 | Germany . |
| 3-116144 | 5/1991 | Japan . |

OTHER PUBLICATIONS

Leedal Catalogue No. 79, pp. 2–24, *Professional Processing Equipment* (Apr. 1989).

Omega/Arkay 1992 Catalog, pp. 19–32, *Professional Photographic & Darkroom Equipment.*

*Primary Examiner*—D. Rutledge

*Attorney, Agent, or Firm*—Howrey & Simon; Stephen T. Schreiner

[57] ABSTRACT

A compact integrated system for film and print processing has chemical processing trays, sink, water filter and faucet, chemical storage, and drying screens integrated into a single multi-purpose unit. The wheeled chemical processing trays are vertically stacked and rolled in horizontal corrugations traversing the length of the sink. A print under development is directly transferred vertically between chemical processing trays across a print sponge with a print gripper. Each print is uniformly processed in a chemical processing tray by rolling the tray, ensuring uniform distribution of the processing chemical without manually agitating the print. The water rinse step of the print development process is accomplished in an oscillating wash bath wherein the water is continuously circulated over and between the prints being rinsed. Each of the processing chemical trays may be angled downward for emptying into a basin which can also provide a sink as well as safe recycling/disposal following print processing. A hinged top cover provides a secure mounting for a water filter/faucet, a combination light table and safe light, and a scaled work surface when closed.

19 Claims, 32 Drawing Sheets

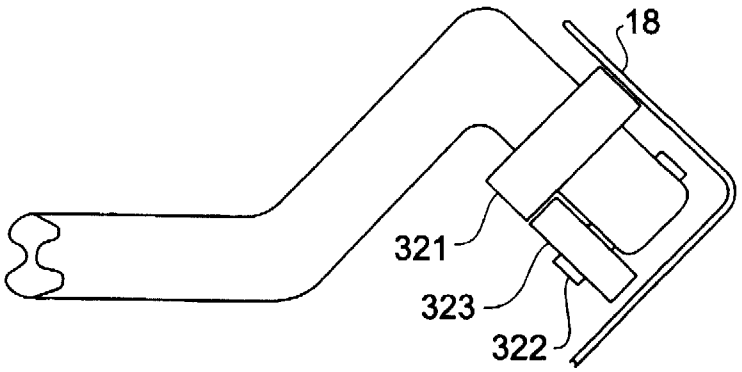
FIG. 25A
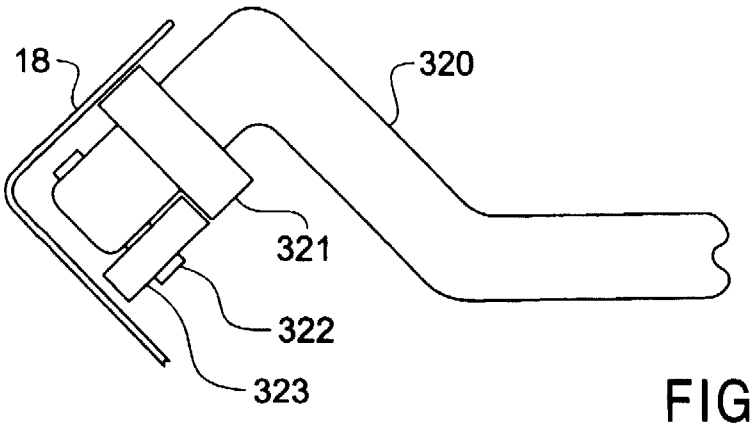
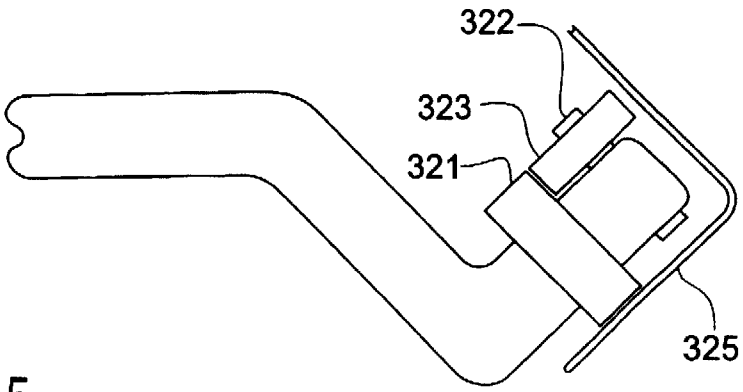
FIG. 25
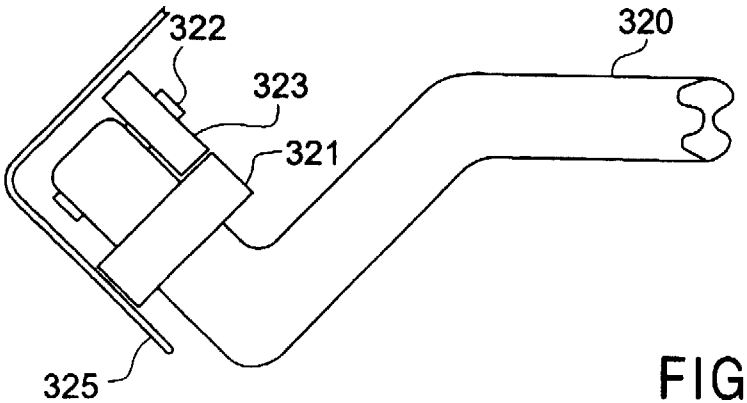

PHOTOGRAPHIC PROCESSING SYSTEM

CROSS REFERENCE TO RELATED APPLICATION

This application is a continuation-in-part of application Ser. No. 08/348,981 filed Nov. 28, 1994 now U.S. Pat. No. 5,579,073.

BACKGROUND OF THE INVENTION

The present invention relates to photographic processing equipment, and specifically to an integrated system for complete photographic processing in a minimum space. The present invention incorporates the components of a standard darkroom, including a basin, water system, processing chemical trays, wash bath, light table, safety light, drying screens and storage areas into a single integrated unit.

A standard photographic print is produced by exposing a sheet of paper coated with photosensitive chemicals, typically silver halide, to light projected through an image. Once a photographic image is recorded on the silver halide crystals of a sheet of print paper, typically by illuminating the print with a "negative" image projected through an enlarger, the chemicals on the print are processed to develop and "fix" the image onto the paper by treating the print with processing chemicals. After the print has been processed with three separate chemicals (developer, stop bath and fixer) the print is washed in water to remove any excess chemicals remaining on the print and dried.

In conventional photographic print development, these processing chemicals are found in shallow trays arrayed horizontally on a flat surface, typically a smooth countertop in a darkroom. These trays are normally arranged linearly, adjacent to each other on the countertop. A print being developed is first placed into the tray filled with developer, then transferred from the developer to the stop bath to the fixer to the wash area by manually carrying the print to and between the trays with a pair of tongs. Because each print is processed by "agitating" the print in a tray, moving it back and forth while completely submerged in the processing chemical to ensure thorough and uniform coverage, each tray has to be filled to a relatively great depth. This has the undesirable effect of wasting processing chemicals and precipitating accidental spillage.

During processing, each print is normally held vertically over a tray before transfer to the next tray to allow any excess chemical absorbed by the print or adhering to the surface to drip off the print. However, this frequently cannot be done when oversized prints (e.g., 20"×24") are being developed because of the high probability of creasing the print while trying to raise it. In addition, for very large prints, it is simply not possible to raise the print high enough without assistance. These problems are particularly acute when archival prints are being developed because of the high porosity and absorptive properties of the fiber based paper used.

Another problem frequently encountered during traditional print processing in a photographic darkroom is that the prints tend to accumulate in a pile in the wash area where they are stacked directly on each other. This stacking prevents the water from adequately rinsing the chemicals off each print unless the water flows through the wash area under relatively high pressure. However, in addition to wasting water, high pressure water tends to fold and crease oversize prints without providing adequate rinsing and thus limits the number of oversize prints that can be efficiently developed.

Another problem encountered while processing oversized or archival prints is the tendency of these prints to fold or crease after the wash stage when the print is squeegeed. Using a conventional squeegee, it is extremely difficult to apply sufficient perpendicular compressive force while moving the squeegee in a straight line, and the squeegee is often skewed in the process, folding or creasing the print.

The traditional linear arrangement of development chemicals is particularly disadvantageous when developing oversized prints as the large trays needed to adequately cover the surface of each print can require a prohibitively large flat surface. If an adequately large surface is unavailable, a photographer may be forced to place the trays on the floor or somehow attempt to reuse a single large tray. Neither of these alternative procedures is regarded as satisfactory.

Another disadvantage of the traditional linear arrangement of print development chemicals is that when a photographer chooses to stop developing prints for a short period, oxidation and/or evaporation will quickly damage the chemicals unless the flow of air over the chemicals is reduced. Although this may be done by covering each of the individual trays used to develop standard size prints, it is impractical with the trays necessary for the development of oversized prints because of the large surface area which must be covered, ideally without any portion of the cover coming into contact with the chemical.

A photographer wishing to develop his or her own photographs has traditionally required a separate room that can be isolated from outside light and has a sink, a light table, a safe light, sufficient level countertop space to arrange the trays of development chemicals and wash bath, drying racks for the prints and storage space for the processing chemicals. These requirements cannot be met by an amateur photographer or a professional photographer without the resources for his or her own studio and darkroom. Furthermore, even a photographer with access to a typical darkroom with standard equipment is usually unable to develop prints larger than 11"×14" because of the processing problems inherent in their large size.

SUMMARY OF THE INVENTION

The present invention is an integrated darkroom facility for photographic processing that addresses the problems of inadequate space that frequently prevent photographers from developing their own prints or developing large prints without incurring prohibitive costs. By integrating all of the processing features of a typical darkroom (sink with a faucet, three chemical processing trays and a wash bath connected to a continuous water supply, a level work surface, a safety light, a light box, print drying racks, and storage areas for the chemicals) into a single unit incorporating a novel arrangement of print development processing chemicals in a vertical array of moveable processing trays, the drawbacks of the traditional linear arrangement of print development chemicals are overcome and photographers are able to process photographs in a fraction of the space previously required.

The photographic processing system disclosed herein occupies a minimum horizontal space while simultaneously enabling the development of oversized prints (using appropriate size trays) without requiring prohibitive amounts of countertop space or forcing the photographer to utilize unsatisfactory temporary arrangements (i.e., the floor). Each individual chemical processing tray is designed to be smoothly rolled back and forth, eliminating the need to manually agitate each print, and advantageously requires significantly reduced quantities of processing chemical in each tray. This novel arrangement of processing trays allows a photographer, while using trays that have the same length and width as standard print processing trays, to array the trays in a fraction of the horizontal space previously required. In addition to requiring less space, the present invention enhances the efficiency of photographic print development by providing an enhanced system for transporting prints to and between trays.

Three chemical processing trays (developer, stop bath and fixer) and an oscillating wash bath are vertically arrayed in the corrugated housing of the present invention. Each corrugation extends horizontally the length of the housing and provides a smooth and flat path along which each chemical processing tray can move. The ease with which the chemical processing trays are smoothly rolled back and forth, in conjunction with the wave guards integrated into each processing tray, enables each print to be processed by rolling the tray rather than manually agitating the print in a stationary processing tray. Because each stage of print processing is accomplished by moving the tray instead of moving the print, the quantity of processing chemical required is approximately half that typically required for a stationary tray. The oscillating wash bath disclosed herein ensures that every print is thoroughly rinsed by constantly recirculating water, eliminating problems of uneven rinsing and undesirable chemical deposits on the print. Relative to conventional print wash systems using stationary trays, significantly less water is required because of the continuous motion of water in the oscillating wash bath.

The present invention further enhances the development of oversized prints by facilitating the transfer of an oversized print between trays without creasing by use of the print gripper disclosed herein. The rolling print sponge of the present invention enables excess chemicals to be removed from the prints when moved from tray to tray instead of vertically hanging the print over the tray. Similarly, the rolling squeegee disclosed herein ensures uniform linear application of the squeegee to the print without creasing or folding the print.

The present invention, in addition to requiring less chemicals, also enhances the safety and efficient disposal and/or storage of chemicals used in the development process. The corrugated housing of the integrated photographic processing system of the present invention is safe and easily maintained because of the continuous smooth surfaces that provide smooth paths for the trays without protruding rails or other hazardous sharp edges. Each tray can be tilted without being removed from the housing, and any chemicals in the tray can then flow directly into an integrated basin for recycling or disposal. The present invention also provides for thorough and efficient removal of excess chemicals from prints under development, irrespective of their size, and thorough washing without risking creasing or folding of the print.

A hinged top cover, which also provides a light table, a safety light, a mural printing easel, a level working surface and water distribution, may be closed to cover the processing chemicals and reduce air circulation around the trays, thereby preserving the processing potency of the chemicals without individually covering each tray. In addition, the integrated structure also provides storage for drying screens, processing chemicals, drawers and adjustable shelving underneath the corrugated housing.

The integrated support structure may be extended vertically and horizontally to provide an extended support for a light-blocking enclosure that allows the photographic processing system to be used in a lighted environment as well as supporting sets, lighting or other photographic studio devices. The corrugated shelf-supports provide a user with the flexibility to configure and/or reconfigure the photographic processing system storage shelving and drawers as desired. The water basin of the photographic processing system may also be used as a standard sink for film development, pre-rinsing prints or preparing chemicals.

BRIEF DESCRIPTION OF THE DRAWINGS

FIG. 25 is a partially sectional side view showing an alternative embodiment of the rotating axle of a chemical processing tray in the corrugated sink housing when the tray is level for processing.

FIG. 25*a* is a partially sectional side view showing an alternative embodiment of the rotating axle of a chemical processing tray in the corrugated sink housing when the tray is angled for draining.

DETAILED DESCRIPTION

Figure 1:
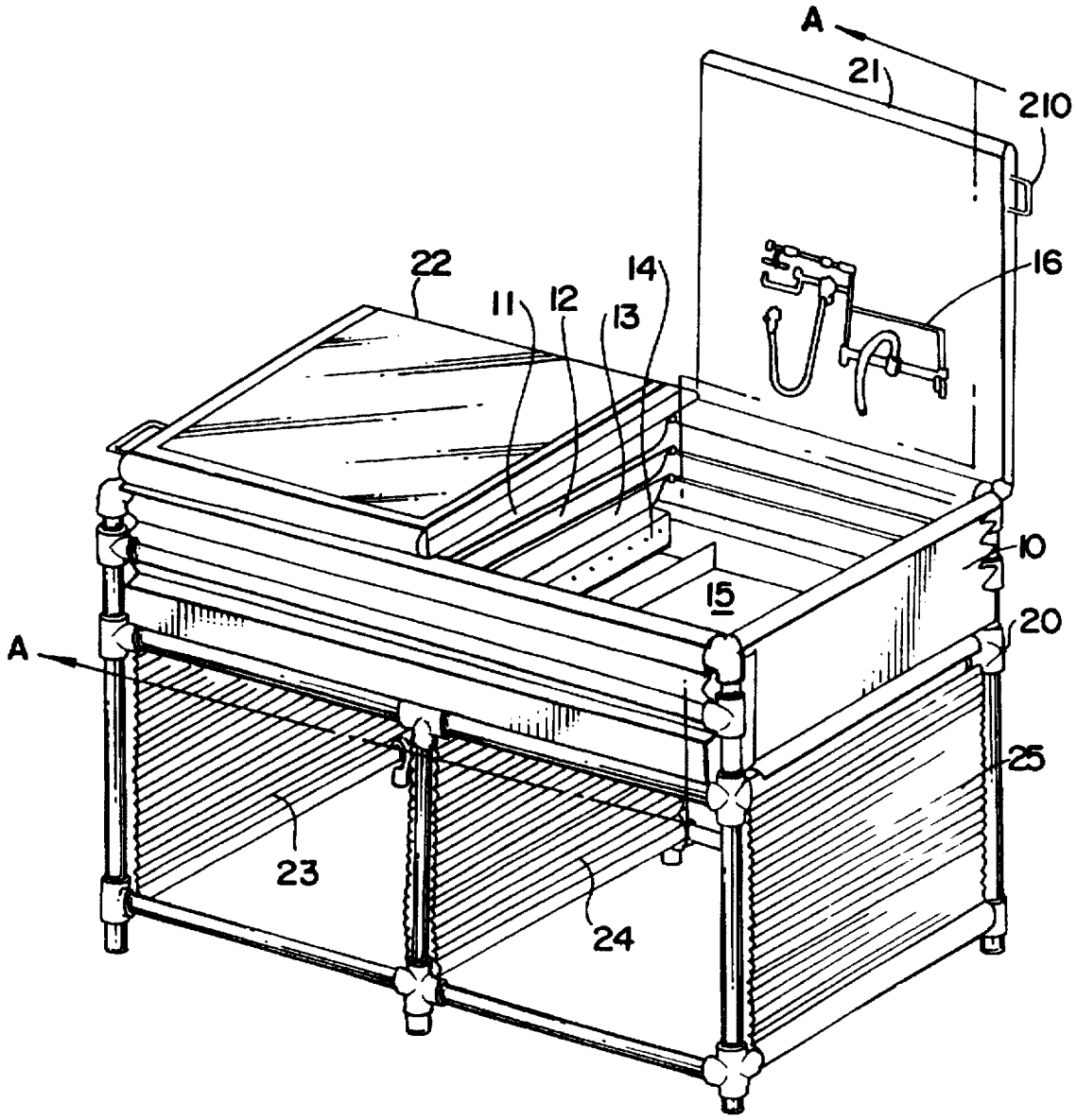
FIG. 1 is a perspective front view of the photographic processing apparatus of the present invention with the water filtration and faucet section of the top cover raised.

As illustrated in FIGS. 1–4 and 19, the photographic processing apparatus is a single integrated unit for photographic processing. The elements required for photographic processing that are normally arrayed throughout a darkroom are found on, in or underneath generally rectangular corrugated sink housing 10. As shown in FIG. 1, the chemical processing trays 11, 12 and 13, containing developer, stop bath and fixer, respectively, an oscillating print wash bath 14, and a sink basin area 15 are disposed within corrugated sink housing 10. Top cover 21, 22 is supported by and encloses corrugated sink housing 10. Water filtration and faucet system 16 is mounted on top cover 21 and a safe light and light box are incorporated into top cover 22. Tubular housing 20 both elevates and supports corrugated sink housing 10 and provides mounting for corrugated drying screen/shelf supports 23, 24 and 25 underneath corrugated sink housing 10. Print gripper 30, rolling print sponge 160 and rolling print squeegee 19 ensure that a print developed in the photographic processing system of the present invention is not creased or folded.

The dimensions of the photographic processing apparatus will vary in proportion to the size of the prints intended to be developed therein. In the preferred embodiment, the internal length of corrugated sink housing 10 is twice the length of each chemical processing tray 11, 12 and 13. The internal width of corrugated sink housing 10 at the apex of the outwardly protruding corrugations is preferably slightly greater than the length of the axle, including wheels, on each chemical processing tray. The flat bottom surface of each chemical processing tray is preferably slightly greater in both length and width to the corresponding dimensions of the print being developed. However, because significantly less processing chemicals are required for each tray, it is economical to process relatively smaller prints with larger trays.

Referring now to FIG. 1, chemical processing trays 11, 12 and 13 are shown in storage mode wherein the chemical processing trays are aligned vertically over oscillating wash bath 14 and basin area 15 is unobstructed. A two part top cover may be mounted to hinges affixed to the rear of corrugated sink housing 10 and provides a mounting surface for water filtration and faucet 16 on first cover 21, shown fully open. A rectangular handle 210 assists the user in raising and lowering the cover. The second cover 22 is shown in the closed position.

Figure 2:
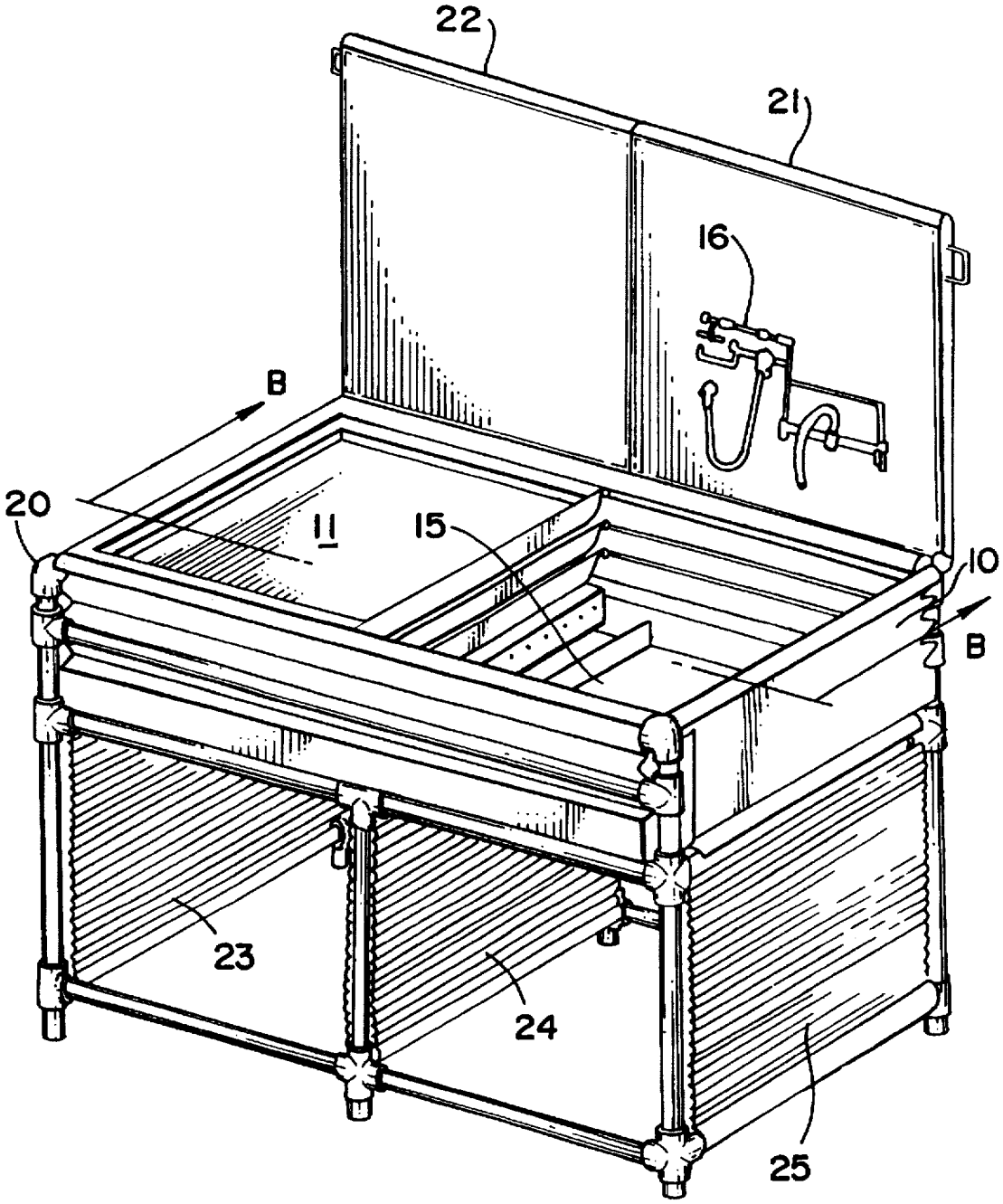
FIG. 2 is a perspective front view of the photographic processing apparatus of FIG. 1 with both sections of the top cover raised.

FIG. 2 shows the photographic processing system with first cover 21 and second cover 22 in the full open position. The bottom surface of second cover 22 is preferably constructed of a transparent or translucent material. A first fluorescent light fixture may be affixed inside second cover 22 to provide illumination, and if the first fluorescent light emits red light, this light acts as a safety light, providing illumination at a frequency that does not interfere with print processing.

Figure 3:
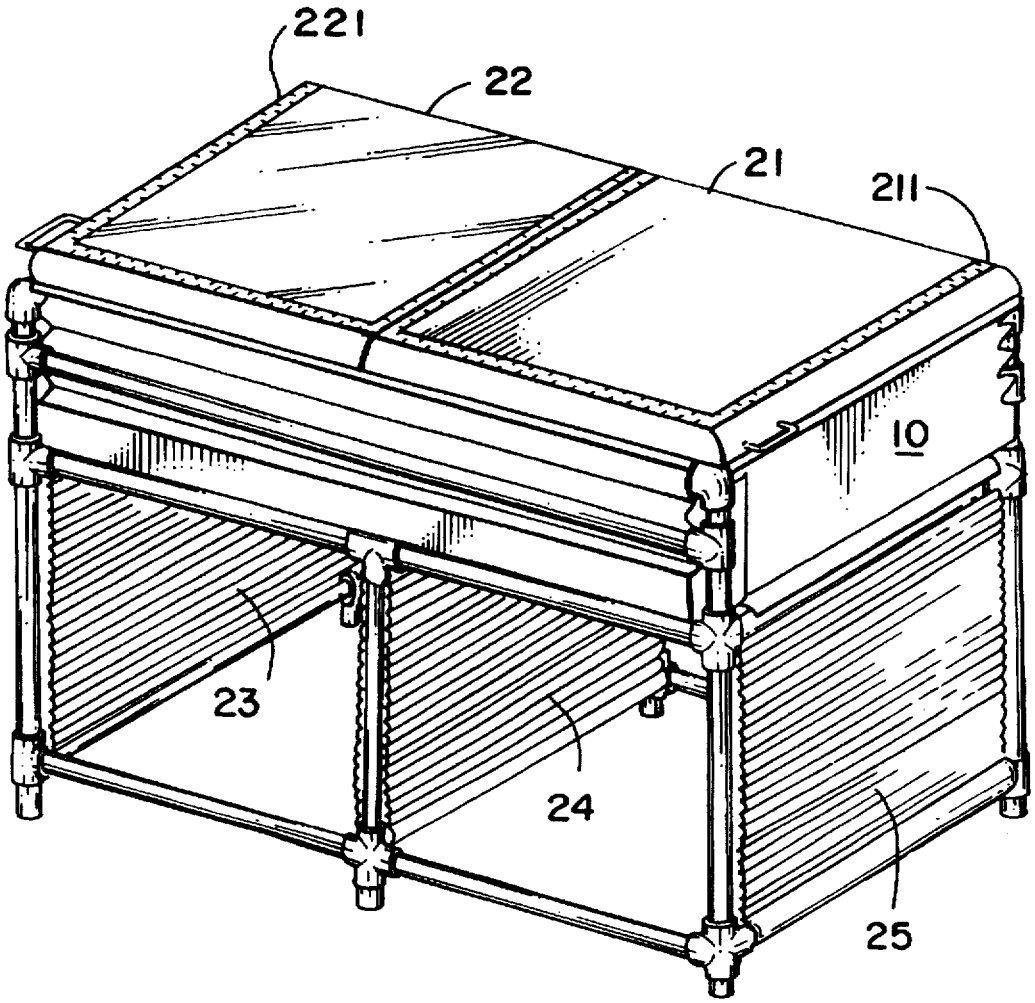
FIG. 3 is a perspective front view of the photographic processing apparatus of FIG. 1 with both sections of the top cover closed.
Figure 19:
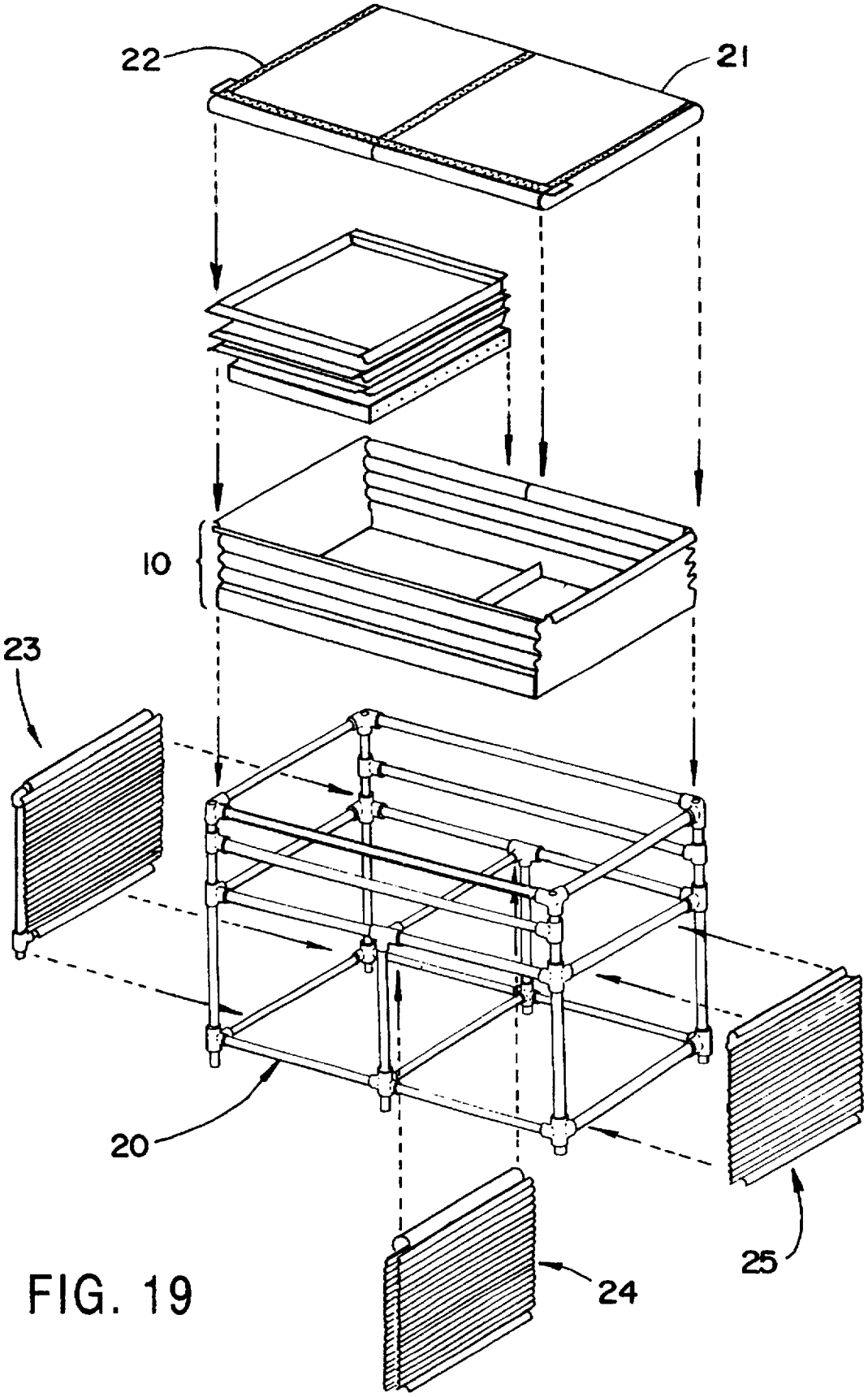
FIG. 19 is an exploded perspective view of the photographic processing apparatus of FIG. 1.

FIG. 3 shows the photographic processing system in standby mode with first cover 21 and second cover 22 in the closed position. Advantageously, an independently operated second fluorescent light fixture may be affixed inside second cover 22 where the top surface is constructed of a transparent or translucent material to provide a light box. In standby mode, the photographic processing system provides a level work surface which can be used as a drafting table or desk. Scale markings 211 and 221 provide guidance for print cropping and other common tasks, as does the separation between first cover 21 and second cover 22. FIG. 19 illustrates the separate elements of the photographic processing system in standby mode.

Figure 7:
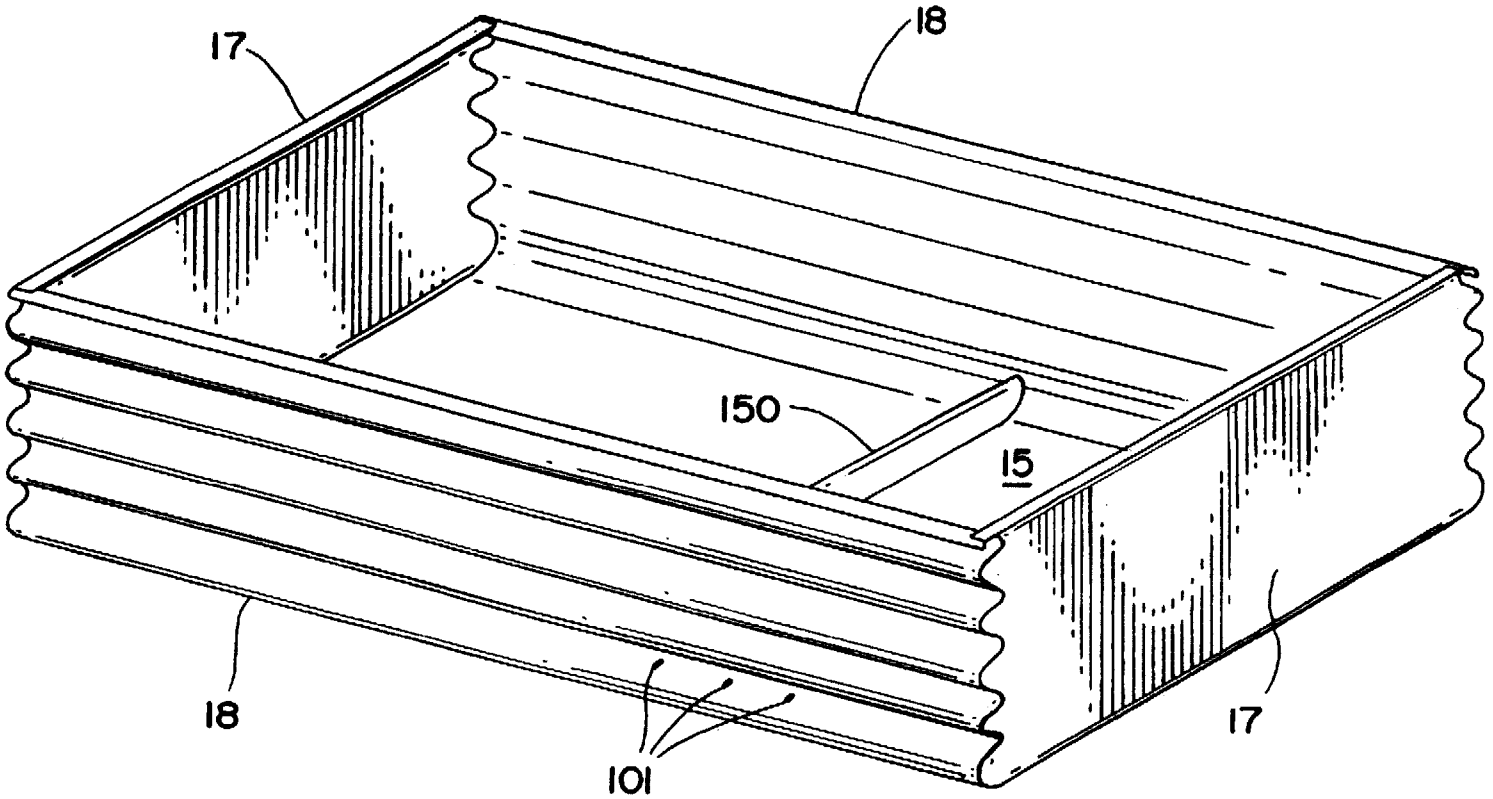
FIG. 7 is a perspective top view of the corrugated sink structure of the photographic processing apparatus of FIG. 1 without the processing trays.

Referring now to FIG. 7, corrugated sink housing 10 is illustrated without chemical processing trays 11, 12, and 13 or oscillating wash bath 14. As shown, first and second corrugated side walls 18 extend between first and second end walls 17. Corrugated walls 18 advantageously provide paths for movement of chemical processing trays 11, 12, and 13 inside corrugated sink housing 10 and first and second end walls 17 provide lateral support and ensure that corrugated sink housing 10 is completely enclosed. In the preferred embodiment, there are four horizontal corrugations in each corrugated side wall 18 with the corrugations mirroring the corrugation of the opposite side wall. Thus, the horizontal grooves formed by the corrugations create linear paths for tray movement. Corrugated sink housing 10 may be constructed of stainless steel, plastic, or any other water-resistant material with sufficient tensile strength to support the processing trays in the grooves formed by the corrugations without excessive deformation.

Apertures 101 in corrugated side wall 18 may provide access to basin area 15 for the disposal and/or recycling of chemicals from the chemical processing trays. A flexible hose (not shown) may be connected between each aperture and storage containers or an environmentally safe container for chemical disposal. Basin area 15 is segregated from the remainder of the bottom surface of corrugated sink housing 10 by vertical wall 150 extending completely between corrugated walls 18. Basin area 15 has an angled bottom surface 151 that directs any liquid retained in basin area 15 by basin area wall 150 toward the center of corrugated sink housing 10. If a level basin bottom is desired, an inversely angled perforated insert may be superimposed on angled bottom surface 151 of basin area 15.

Figure 9:
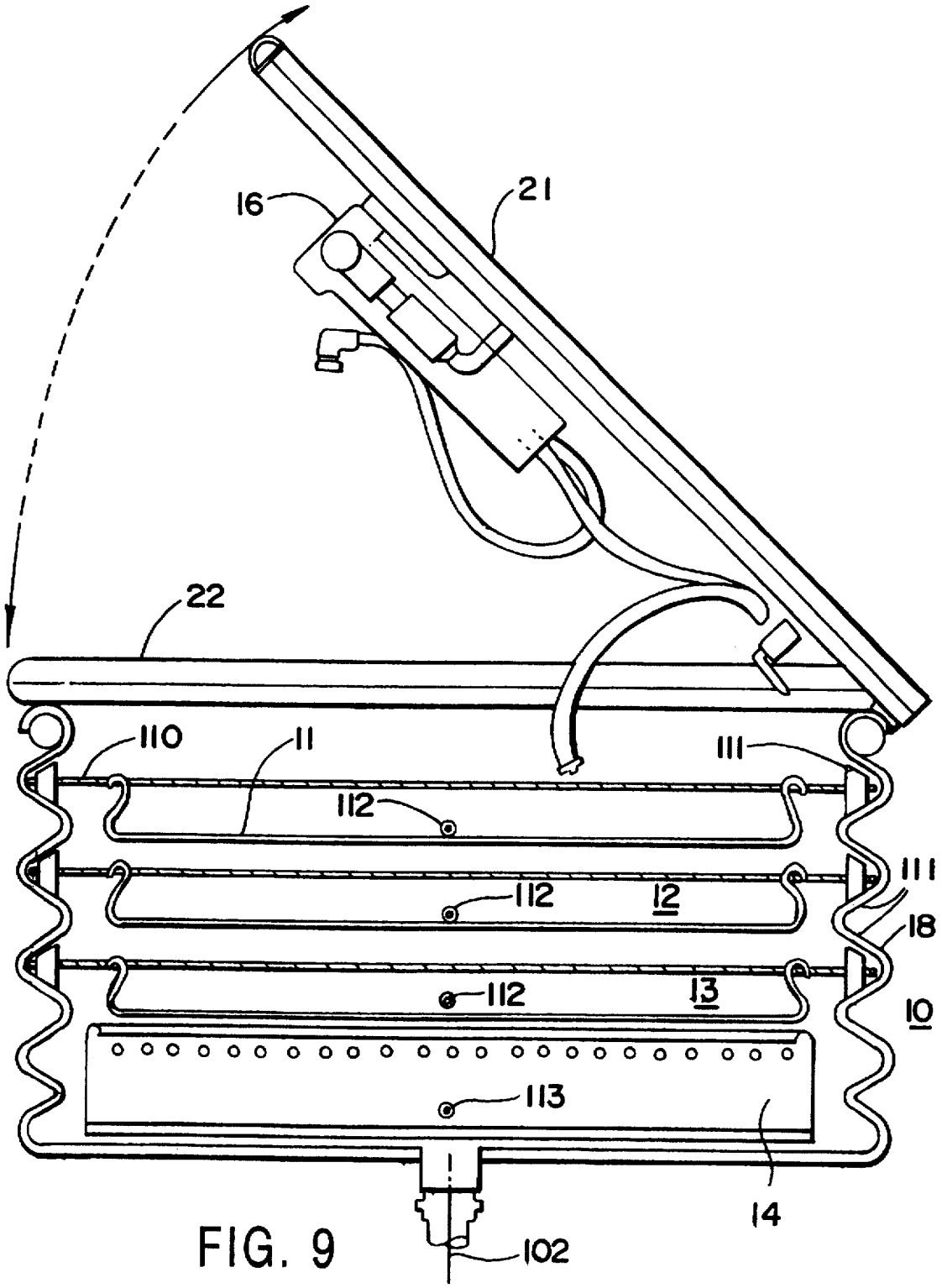
FIG. 9 is a partial cross-sectional side view of the photographic processing apparatus of FIG. 1 taken along line A—A illustrating the chemical processing trays and the conical wheels in the corrugated wheel tracks.
Figure 10:
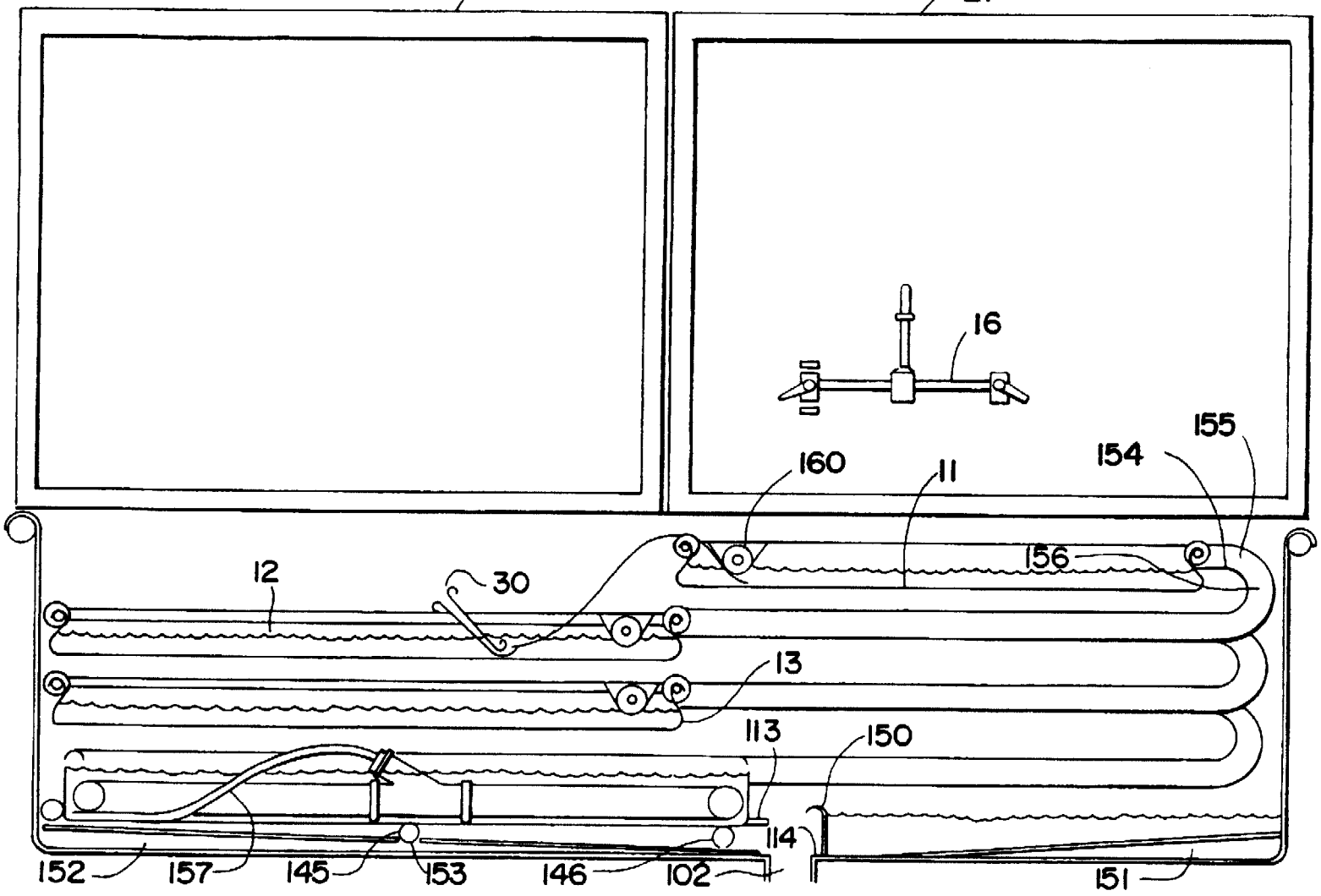
FIG. 10 is a partial cross-sectional front view of the photographic processing apparatus of FIG. 2 taken along line B—B illustrating the movement of a print from the developer bath tray to the stop bath tray.

Referring now to FIGS. 9 and 10, approximately central drain 102 provides a liquid drain outlet for corrugated sink housing 10. Fluids in basin area 15 may be emptied through central drain 102 when drain outlet 114 in vertical wall 150 is opened to provide a passage through basin area wall 150. In an alternative embodiment, the bottom surface of corrugated sink housing 10 may be angled downward such that the rightmost side of the bottom of corrugated sink housing 10 is disposed below the leftmost side. By sloping the bottom surface in this manner, drainage would be enhanced.

Chemical processing trays 11, 12, and 13 each have a drain outlet 112 proximal to the bottom surface of each chemical processing tray. Drain outlet 112 may be advantageously opened to facilitate emptying the chemicals from each chemical processing tray. Oscillating wash bath 14 also has a protruding drain outlet 113 proximal to the bottom of oscillating wash bath 14 for drainage into central drain 102 when print processing is completed.

Chemical processing trays 11, 12 and 13 have substantially equivalent dimensions. For development of typical photographic prints up to 20"×24", the chemical processing trays 11, 12 and 13 have a width of 21" and a length of 25". Unlike conventional trays used in photographic processing, chemical processing trays 11, 12 and 13 have a depth of 2"–2½" as less processing chemicals are required for development when the print is not manually agitated. Chemical processing tray 11, closest to the top of the photographic processing system, contains developer, the first chemical in which the print under development is processed. Chemical processing tray 12, immediately below chemical processing tray 11, contains stop bath, the second chemical in which the print under development is processed. Chemical processing tray 13, immediately below chemical processing tray 12, contains fixer, the final chemical in which the print under development is processed before being washed in water in oscillating wash bath 14, located on the bottom interior surface of corrugated sink housing 10.

Referring now to FIG. 9, axles 110 are removably affixed to chemical processing trays 11, 12, and 13. Each axle 110 is fixedly mounted and does not rotate. Frustum-shaped wheels 111 are rotatably mounted to each end of axles 110 and frustum-shaped wheels 111 rotate freely about axles 110 when processing trays 11, 12 and 13 are moved in corrugated sink housing 10. Frustum-shaped wheels 111 are rubber with pressure fitted nylon bushings that rotate freely about a fixed axle. Each frustum-shaped wheel 111 travels in the horizontal groove formed by the corrugations of corrugated walls 18, thereby allowing each chemical processing tray to be rolled the length of corrugated sink housing 10. Chemical processing trays 11, 12 and 13 may be constructed of ABS, plastic, stainless steel or any material which is water-resistant, rigid and does not absorb chemicals.

Referring now to FIG. 10, oscillating wash bath 14 is generally rectangular and positioned on the bottom of corrugated sink housing 10. The bottom surface of corrugated sink housing 10 underneath oscillating wash bath 14 has a gradual incline 152, bisected by groove 153, sloping from side wall 17 toward central drain 102. Cylinders 144, 145 and 146 are fixedly mounted to oscillating wash bath 14. During normal operation, oscillating wash bath 14 oscillates so that cylinders 144 and 146 are alternately resting on incline 152. Cylinders 144 and 146 act as counterweights during the oscillation of oscillating wash bath 14 and preferentially have an equivalent mass. Cylinder 145, in cooperation with groove 153, acts as a fulcrum upon which oscillating wash bath 14 oscillates. Cylinders 144 and 146 may be metal pipes or constructed of any material with sufficient mass to counterbalance the oscillations of oscillating wash bath 14 under normal operation. Alternatively, cylinder 145 may be triangular or any shape upon which oscillating wash bath 14 can oscillate when cylinder 145 is placed in groove 153.

Figures 13A, 13B:
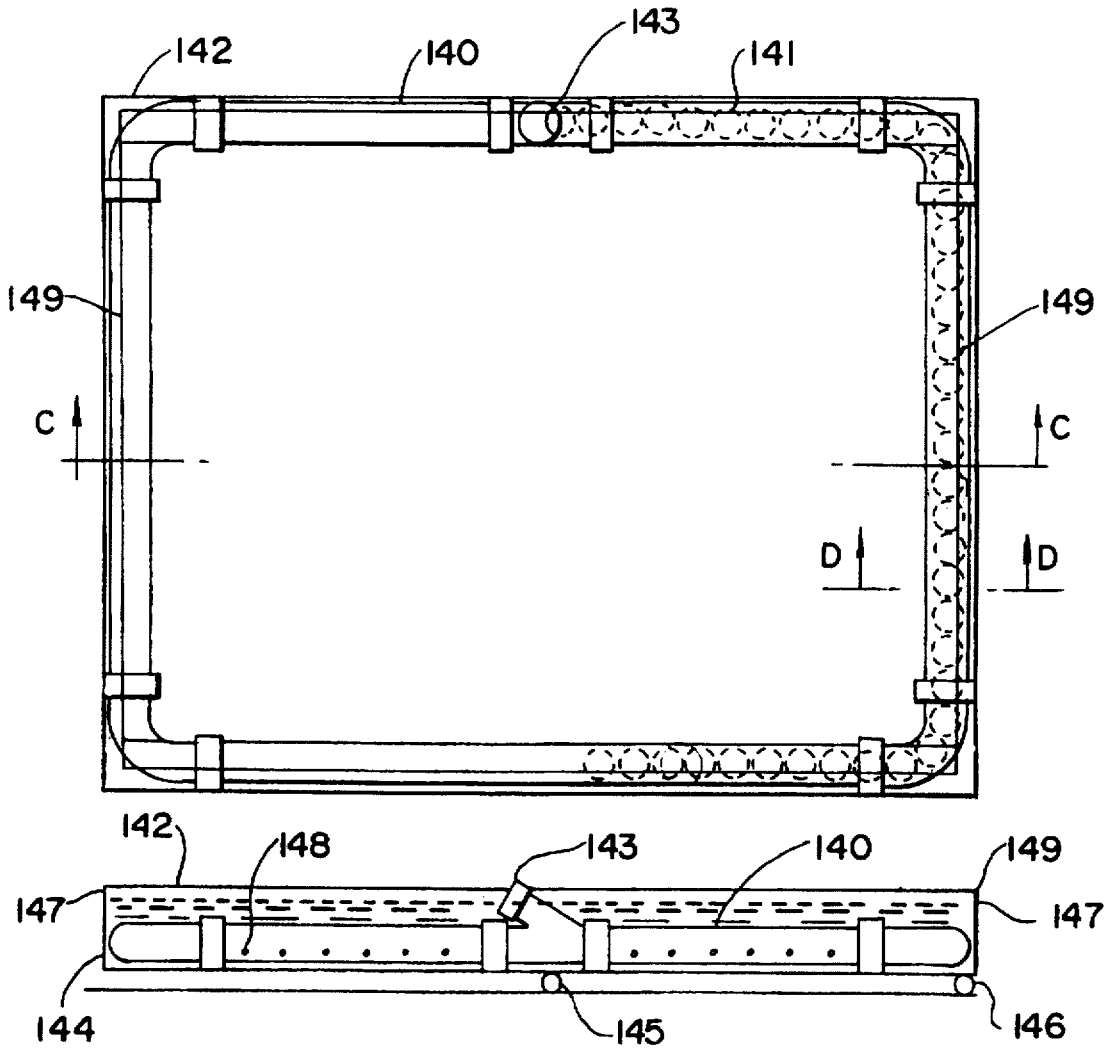
FIG. 13*a* is a partially sectional top view of the oscillating wash bath.
FIG. 13*b* is a partially sectional side view of the oscillating wash bath take along line C—C of FIG. 13*a*.

Oscillating wash bath 14 provides continuous circulation over the prints being washed with water supplied through flexible hose 157. Referring now to FIGS. 13*a* and 13*b*, oscillating wash bath 14 is encircled by rectangular wall 142, including perforated end walls 149. Cylindrical tube 140, adjacent to the interior surface of rectangular wall 142, similarly encircles oscillating wash bath 14. Rectangular wall 142 extends vertically beyond the diameter of cylindrical tube 140 and is arched inwardly at the top to restrict the flow of water out of oscillating wash bath 14 to perforations 147 in end walls 149. The water supplied through flexible hose 157 is received in Y-connector 143 and flows through cylindrical tube 140 which is perforated along its inside edge with a plurality of evenly spaced openings 148 through which water enters oscillating wash bath 14.

Figure 15:
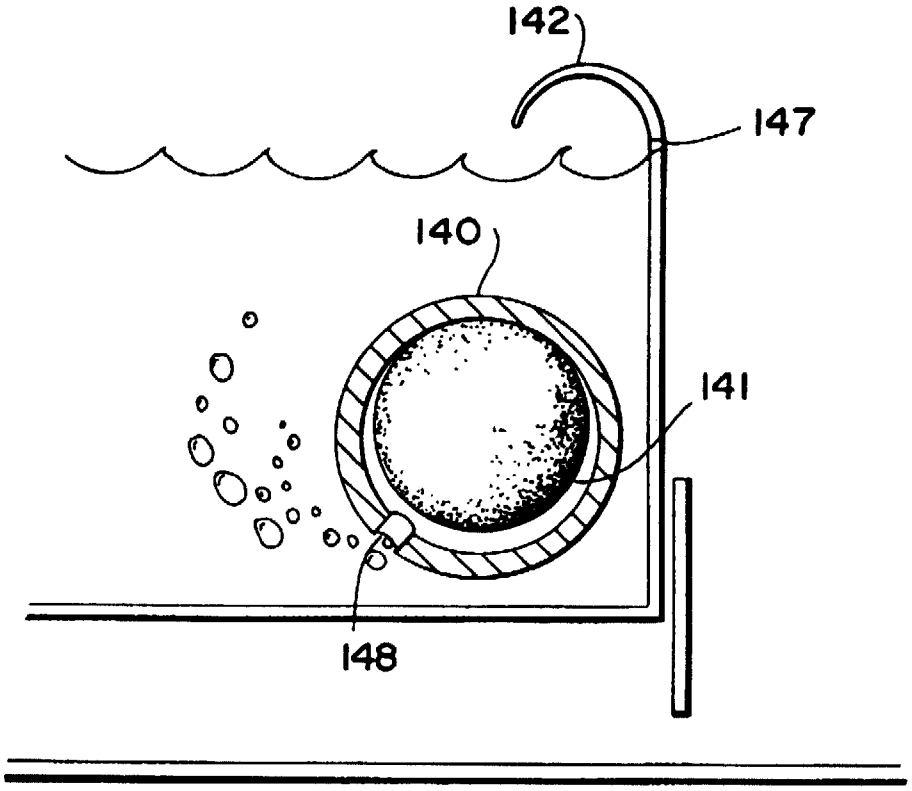
FIG. 15 is a partially sectional side view taken along line D—D of FIG. 13*a* illustrating the operation of the oscillating wash bath.

Half of the internal length of cylindrical tube 140 is filled by a plurality of flexibly interconnected light-weight spheres 141. The light-weight spheres, which may be float balls, ping pong balls or other hollow spheres, are preferentially interconnected with flexible strips of silicone and are propelled through cylindrical tube 140 by the water entering through Y-connector 143. FIG. 15 illustrates the relative dimensions and positioning of cylindrical tube 140, openings 148, lightweight spheres 141 and rectangular wall 142. Rectangular wall 142 is perforated by a plurality of openings 147 at end walls 149 of oscillating wash bath 14, thereby controlling the flow of water out of oscillating wash bath 14 during normal operation.

Figure 4:
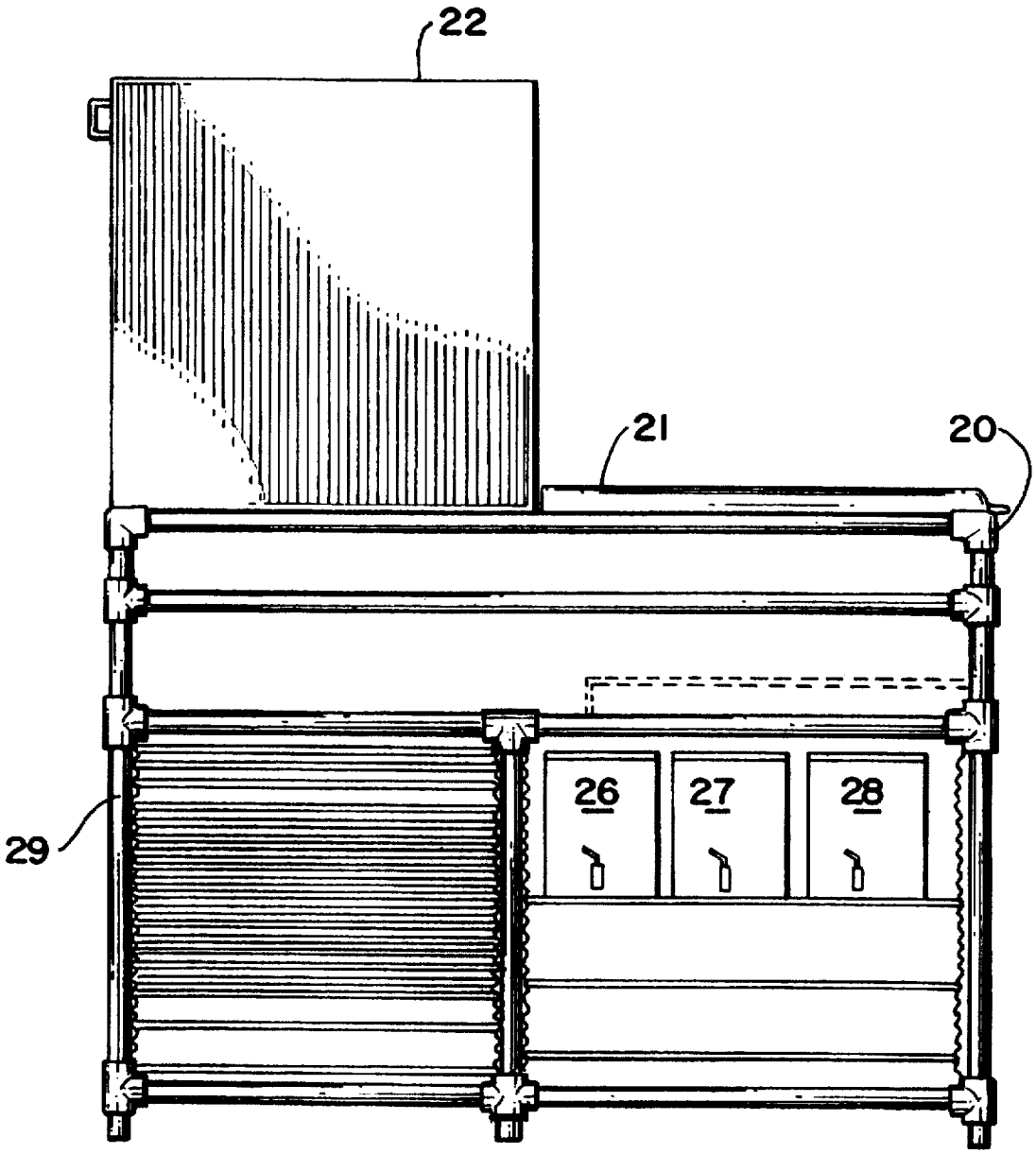
FIG. 4 is a front view of the photographic processing apparatus of FIG. 1 with both sections of the top cover closed showing the drying screens and chemical storage containers underneath the sink portion of the photographic processing apparatus.

As shown in FIG. 4, corrugated drying screen/shelf supports 23, 24 and 25 allow the space underneath sink 10 to be utilized for the storage of processing chemicals in containers 26, 27, and 28. In addition, prints may be placed on drying screens 29 advantageously stacked in the corrugations to ensure adequate ventilation between each drying screen.

Figure 5:
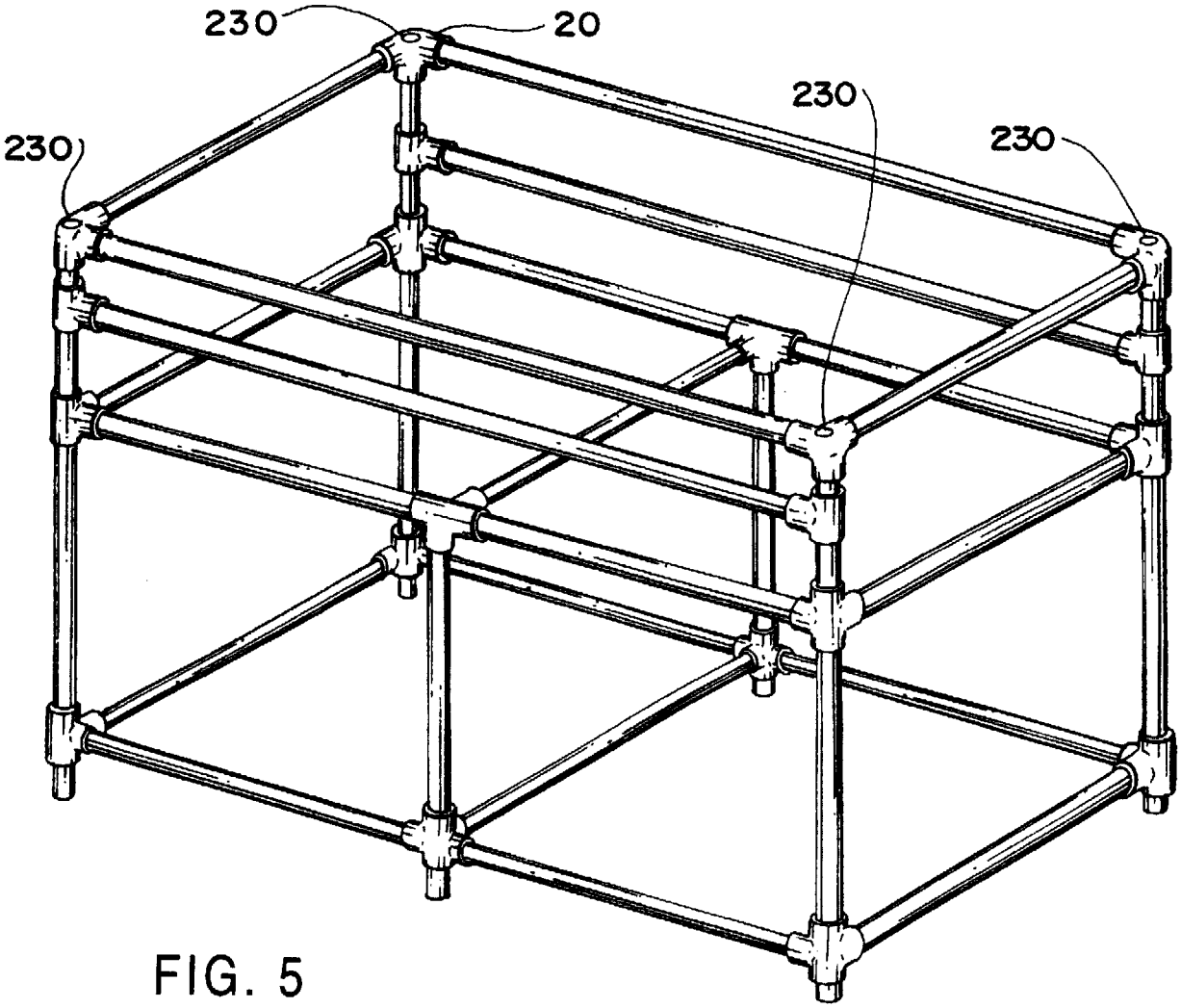
FIG. 5 is a perspective front view of the tubular structure that supports the photographic processing apparatus of FIG. 1.

Referring now to FIG. 5, the tubular support structure 20 of the preferred embodiment is illustrated. Tubular support structure 20 may be constructed of PVC, stainless steel, copper or any rigid material fashioned into cylindrical tubes. The support structure may be extended using apertures 230 or an alternative arrangement to support a canopy arrangement from which a light blocking curtain may be hung in a manner similar to a conventional shower curtain. In this embodiment, several photographic processing systems could provide individualized darkroom facilities in a classroom environment.

Figure 6:
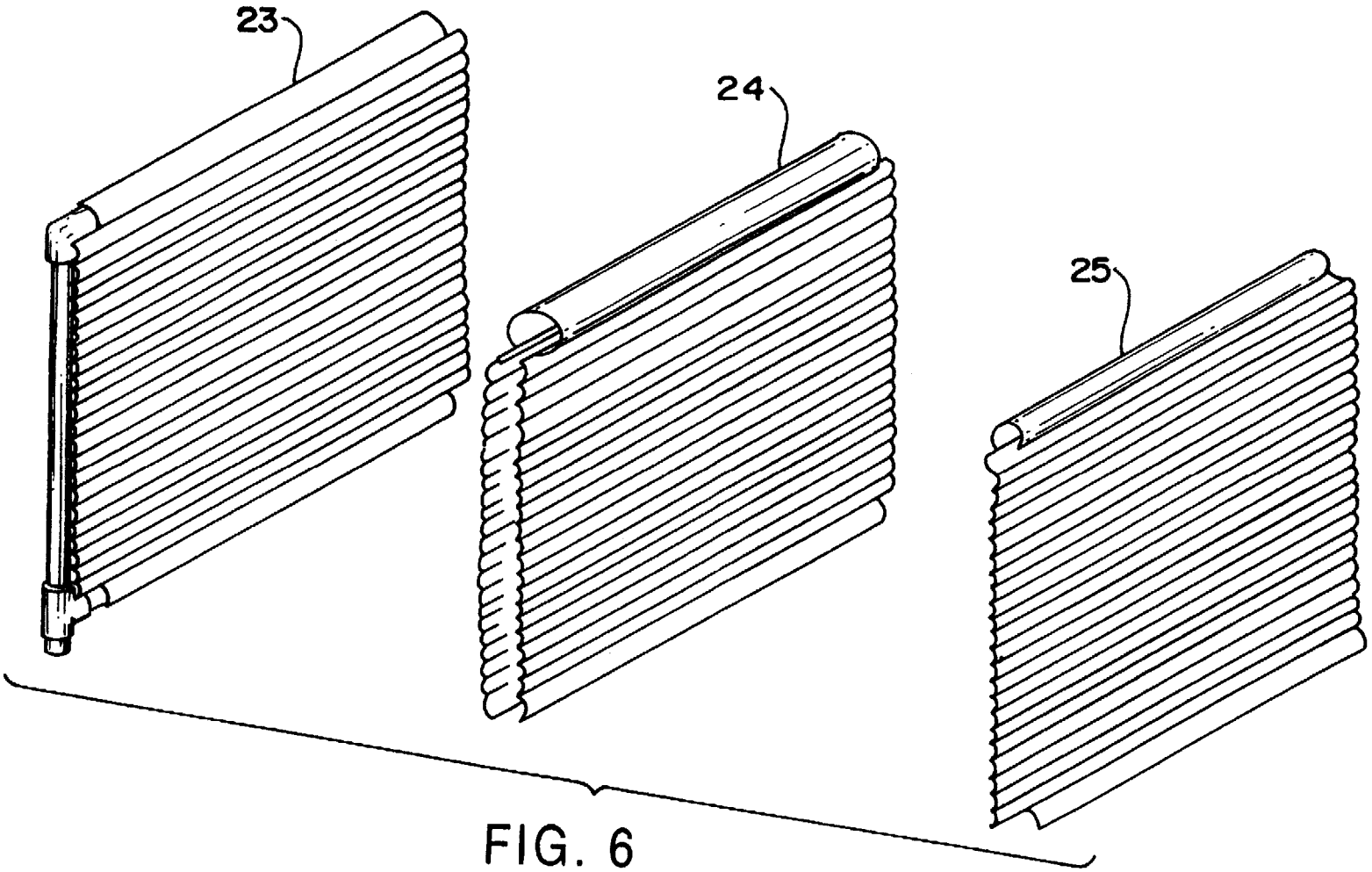
FIG. 6 is a perspective side view illustrating the corrugated shelf supports that are positioned on the outer sides and middle of the lower portion of the tubular structure of FIG. 5.
Figure 24A:
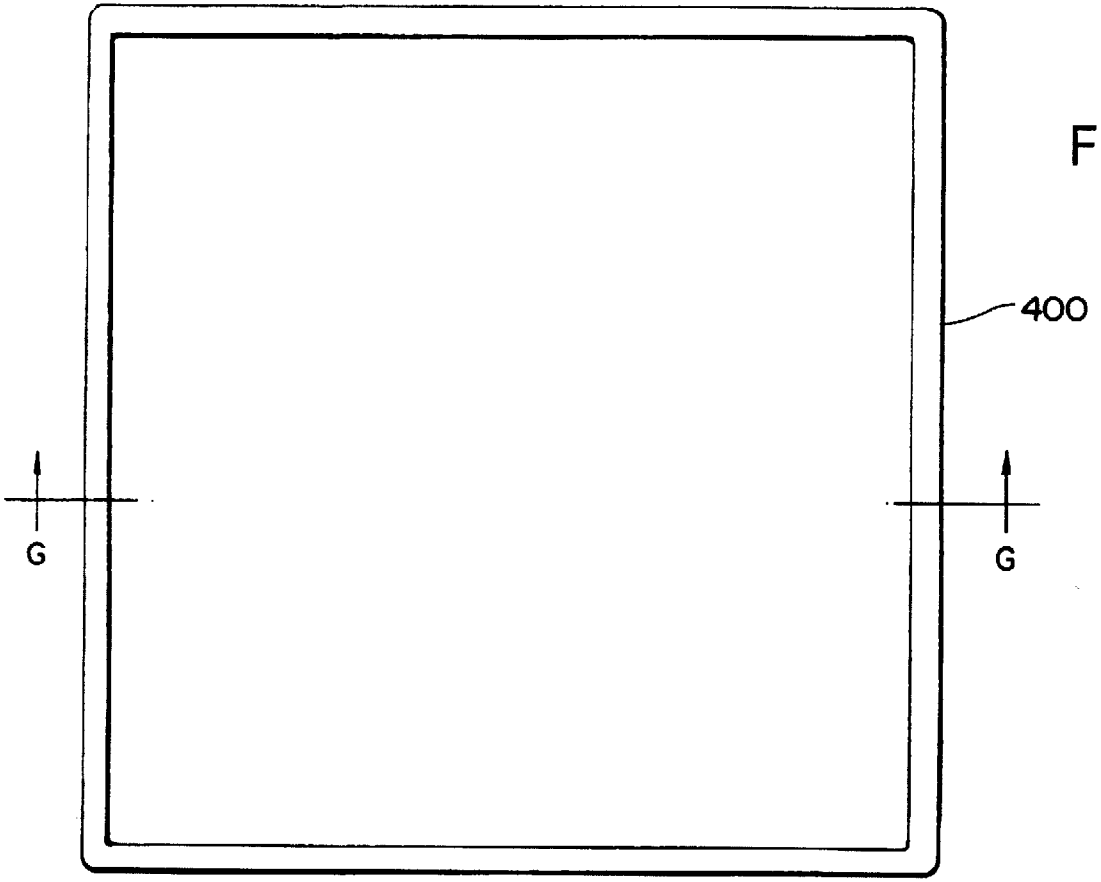
FIG. 24*a* is a top view of a print drying screen.
Figure 24B:
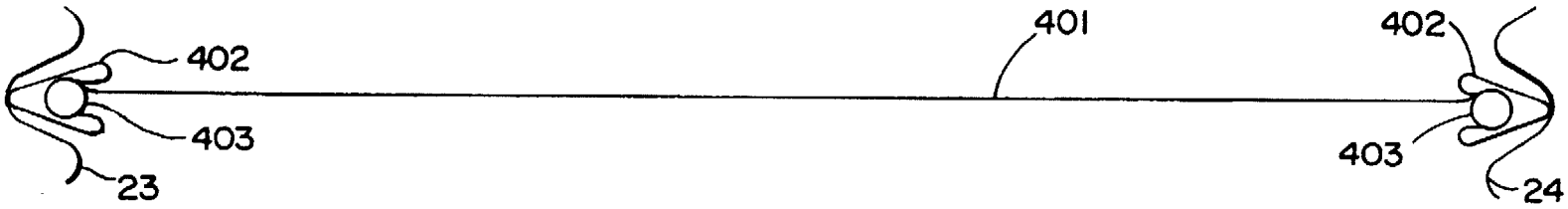
FIG. 24*b* is a cross-sectional side view of a print drying screen taken along line G—G of FIG. 24*a*.

Referring now to FIG. 6, corrugated drying screen/shelf supports 23 and 25 may be single-sided and central shelf-support 24 double-sided. Central shelf support 24 is advantageously constructed by combining corrugated shelf supports 23 and 25. Referring now to FIGS. 24*a–b*, print drying screens 29 have rounded frame edges 402 that obvious advantageously interfit with the grooves formed by the corrugations of the drying screen/shelf supports 23 and 24. A fiberglass screen 401 is stretched taut between rounded frame edges 402 and retained therein by rubber retainers 403.

Figure 18:
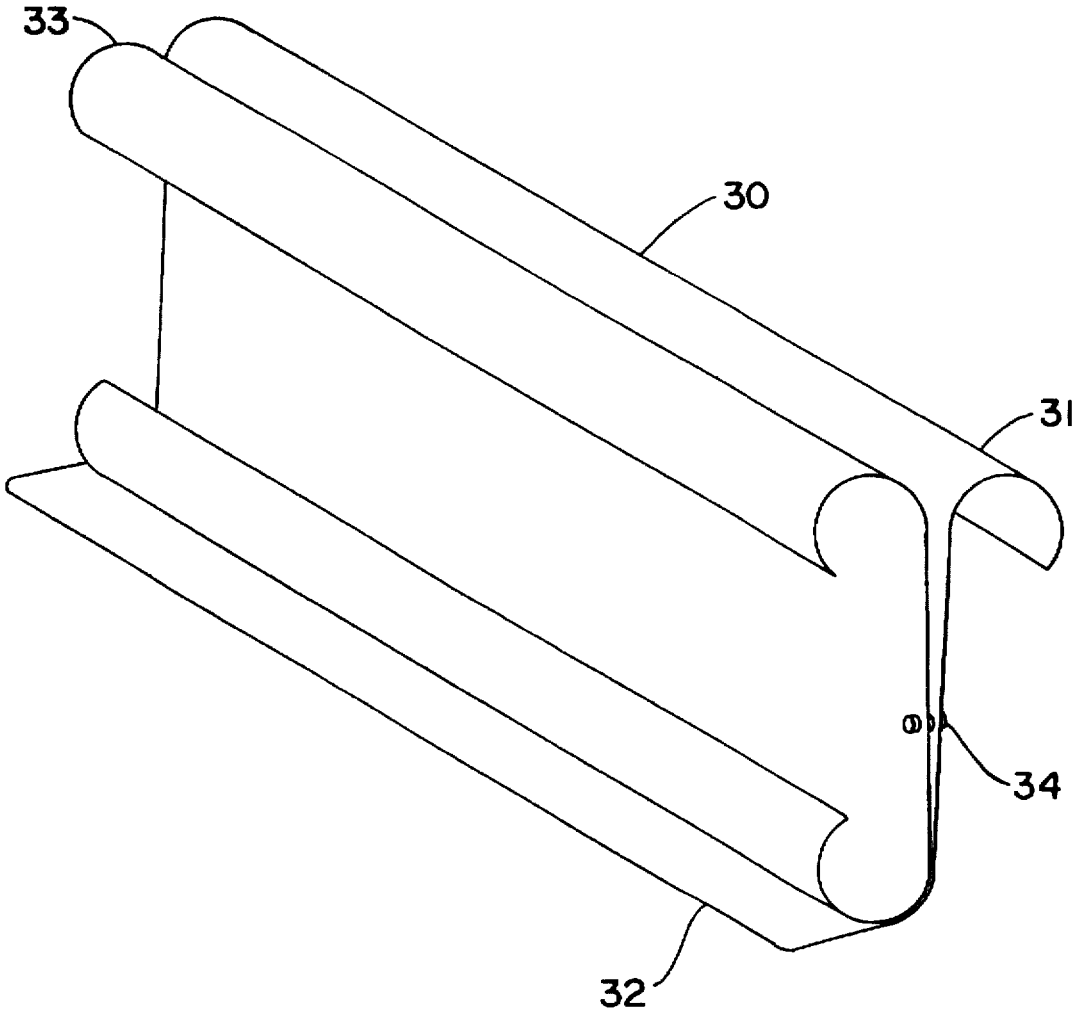
FIG. 18 is a perspective top view showing the print gripper used to transport prints.

Referring now to FIG. 18, print gripper 30 transfers the print without creasing or folding the print. Retaining clip 34 keeps the two gripping surfaces in contact while spring clip 31 compresses curvilinear surface 33 against planar surface 32. The width of print gripper 30 is advantageously equal to or slightly greater than the width of the print being developed, thereby eliminating the possibility of creasing or folding.

Figure 16B:
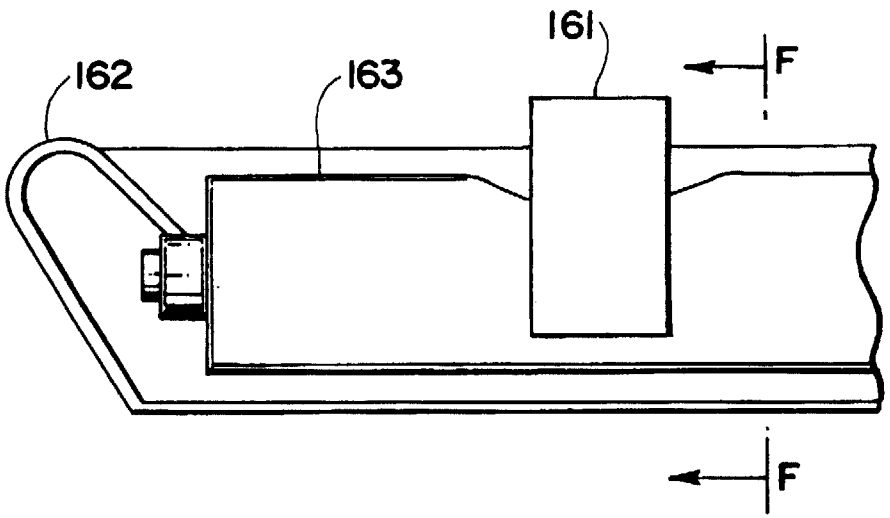
FIG. 16*b* is a partially sectional front view taken along line E—E of FIG. 16*a* illustrating the print sponge mounted to a processing tray.
Figure 16A:
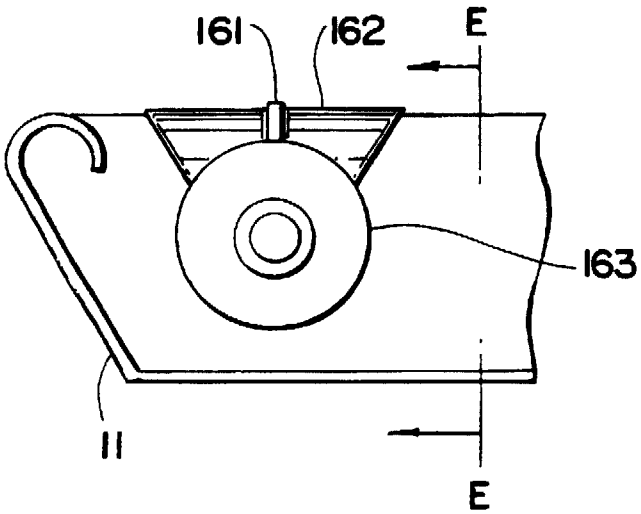
FIG. 16*a* is a partially sectional side view taken along line F—F of FIG. 16*b* illustrating the print sponge removably mounted to a processing tray.

Print sponge 160 removes any excess processing chemical from the print before it is placed into the next tray. Referring now to FIGS. 16*a* and 16*b*, print sponge 160 is cylindrical and equal in length to the width of chemical processing trays 11, 12 and 13. Cylindrical rubber sponge 163 is mounted around a cylindrical rod fixedly mounted to triangular brackets 162 which are removably mounted to the edges of chemical processing trays 11, 12 and 13. Print sponge 160 may be moved using nylon sponge ringer 161 which partially encircles rubber sponge 163 in a C-clamp. Because the diameter of the C-clamp is narrower than the diameter of rubber sponge 163, the area of rubber sponge 163 under sponge ringer 161 is compressed and fluids absorbed by the sponge are ejected. Sponge ringer 161 may be slid along the length of print sponge 160 to remove chemicals absorbed by rubber sponge 163 whenever necessary.

Figure 17:
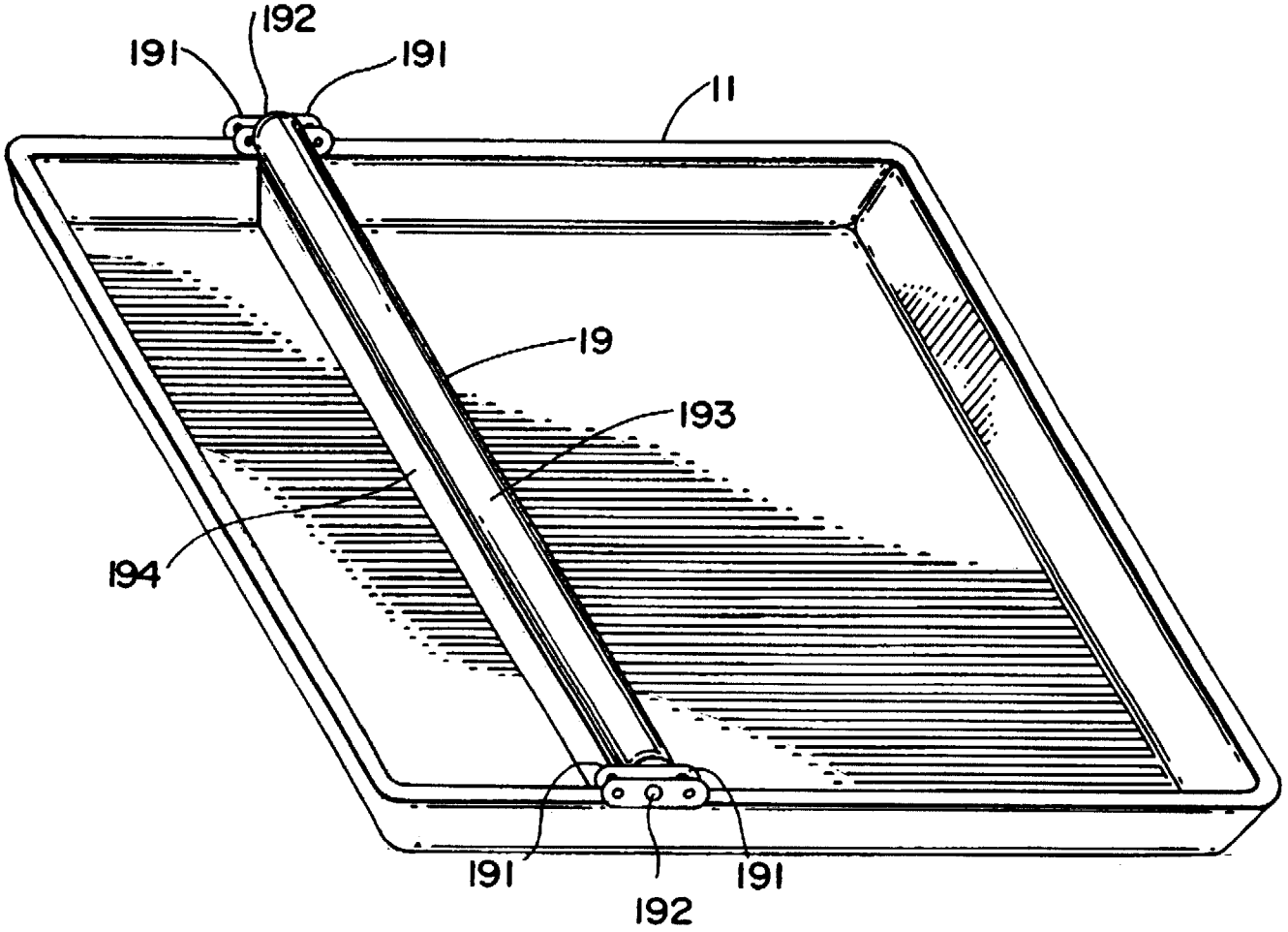
FIG. 17 is a perspective top view showing the rolling print squeegee on a processing tray.

Referring now to FIG. 17, rolling print squeegee 19 may be utilized to squeegee water off of the prints. Cylinder 193 extends the width of processing tray 11 and is bounded on either end by wheel carriers 192. Two concave wheels 191 held in each wheel carrier 192 are in rotating contact with the top of the wall of chemical processing tray 11 when print squeegee 19 is moved along chemical processing tray 11. The dual wheel embodiment of the wheel carriers advantageously ensures that rolling print squeegee 19 remains straight while the print is being squeegeed. Triangular rubber squeegee 194 fixedly mounted to cylinder 193 is extends the height of the walls of chemical processing tray 11 and therefore applies pressure to prints in chemical processing tray 11 to remove any excess water.

Figure 8:
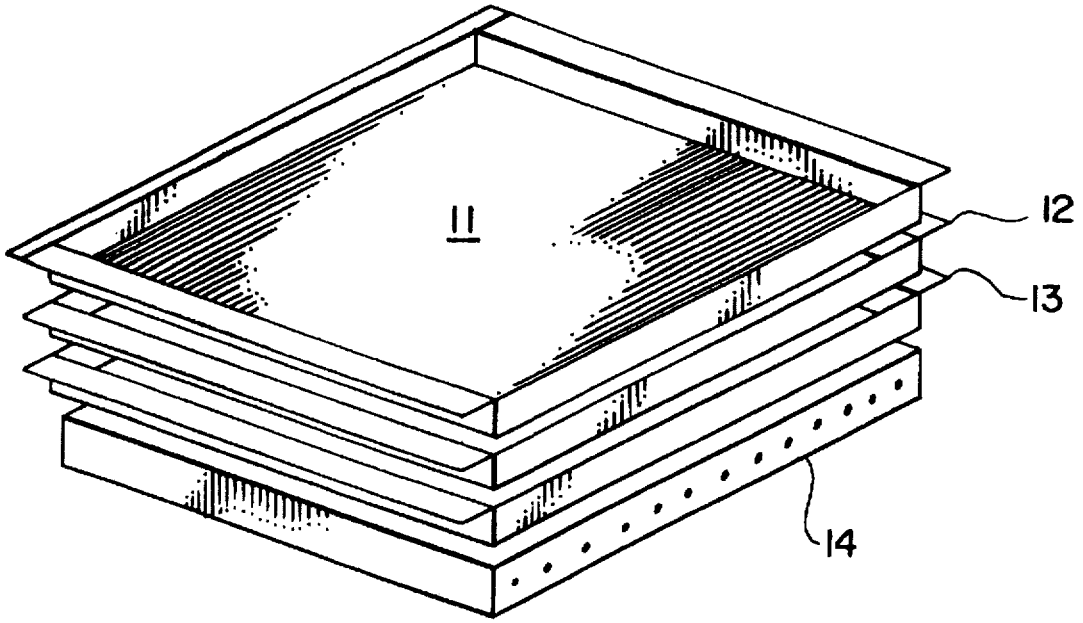
FIG. 8 is a perspective top view of the photographic processing apparatus of FIG. 1 showing the vertical arrangement of the processing trays.

The process by which a print is developed using the photographic processing apparatus is illustrated in FIG. 10. Basin area 15 may be filled with water from water filtration and faucet 16 and used to pre-rinse the prints before processing. Referring now to FIG. 8, chemical processing trays 11, 12 and 13 and oscillating wash bath 14 are shown in storage mode, with chemical processing trays 11, 12 and 13 in a stack over oscillating water bath 14. By placing chemical processing trays 11, 12 and 13 in storage mode, access to basin area 15 is completely unobstructed, allowing basin area 15 to be used as a deep sink to prepare chemicals, process film or other such tasks.

Figure 20A:
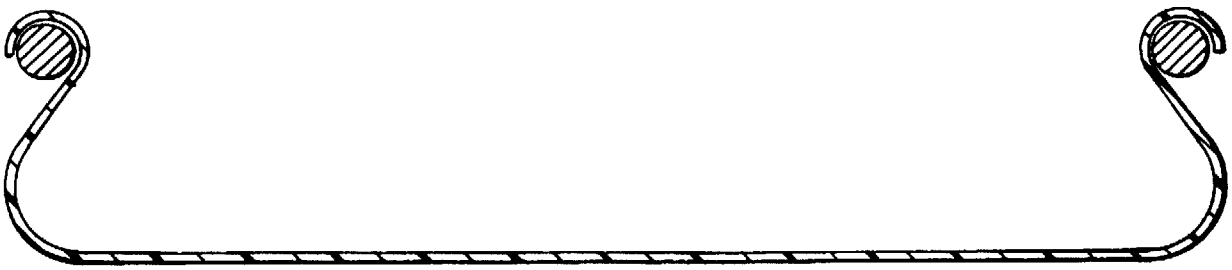
FIGS. 20*a–c* are cross-sectional side views illustrating alternative implementations of the wave guard feature of the processing trays of the photographic processing apparatus.
Figure 20B:
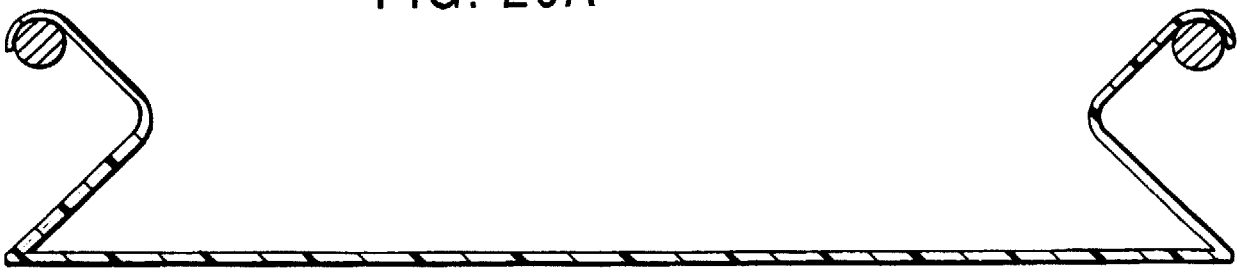
Figure 20C:
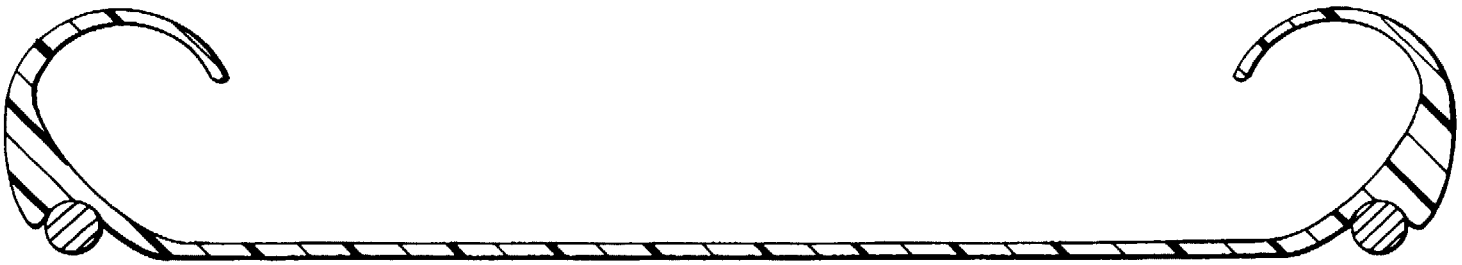

After pre-rinse in basin area 15, the print under development is then placed into the developer in chemical processing tray 11. Advantageously, the print may be moved without creasing or folding using print gripper 30. While the print is immersed in the developer in chemical processing tray 11, the chemical processing tray is rolled back and forth to ensure continuous even distribution of the developer over the entire print. By rolling the tray instead of manually agitating the print, significantly less processing chemicals are required to ensure adequate processing in each tray and the depth of each tray may be significantly less than conventionally required. The processing chemicals are prevented from inadvertently splashing out of the chemical processing tray by a wave guard integrated into the end walls of each chemical processing tray as illustrated in FIG. 20*a*. Referring now to FIG. 20*a*, the end walls of the chemical processing trays are angled inward to inhibit any waves generated by the rolling motion. Alternative embodiments of the wave guard are illustrated in FIGS. 20*b–c*.

Referring again to FIG. 10, once the image is sufficiently developed, chemical processing tray 11 is rolled to the opposite side of corrugated sink housing 10. Excess chemicals are removed from the print under development when it is advantageously moved under and across print sponge 160. Once a print under development has been completely immersed in the stop bath in chemical processing tray 12 the print is then transferred to the fixer in chemical processing tray 13. This is advantageously accomplished by gripping the print with print gripper 30 and rolling chemical processing tray 12 while holding the print under development stationary. As chemical processing tray 12 is moved, any excess stop bath is sponged off the print by print sponge 160 and the print is gradually immersed in the fixer in chemical processing tray 13 below. This procedure may be repeated when transferring the print under development from chemical processing tray 13 to oscillating wash bath 14. The print is left to be washed by the continuously circulating water, chemical processing trays 11, 12, and 13 are returned to the storage mode position and another print can be developed.

Figure 14A:
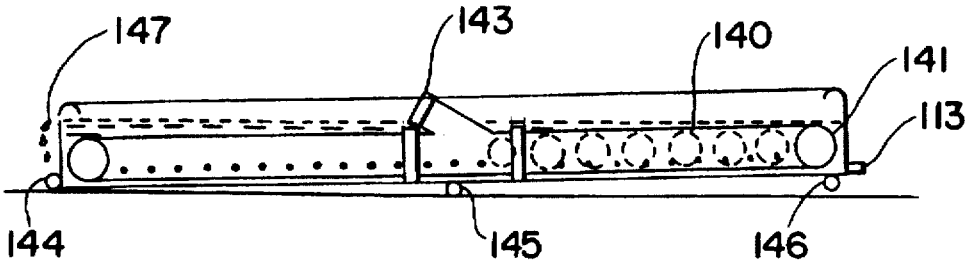
FIGS. 14*a–c* are partially sectional side views taken along line C—C of FIG. 13*a* illustrating the operation of the oscillating wash bath.
Figure 14B:
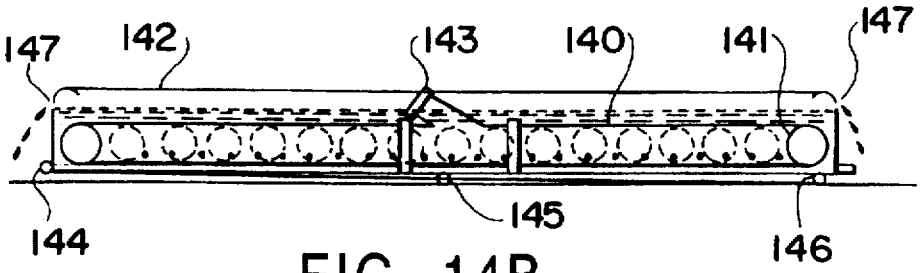
Figure 14C:
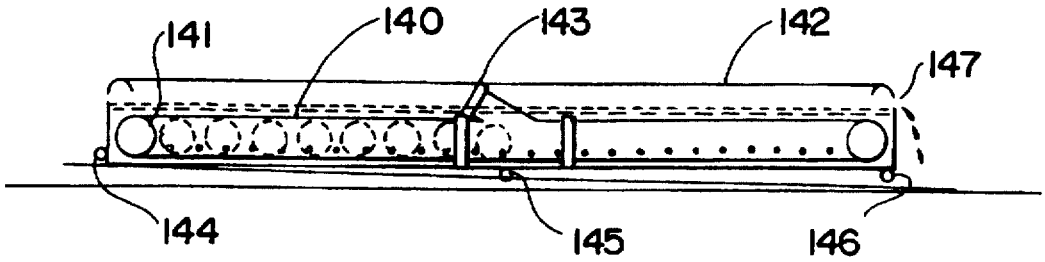

Referring now to FIGS. 14*a–c*, the operation of oscillating wash bath 14 is illustrated. In FIG. 14*a*, lightweight spheres 141 occupy the entire right half of cylindrical tube 140 and water completely fills the remaining half. Because of the greater weight of the water in the other half of cylindrical tube 140, oscillating wash bath 14 is tilted on fulcrum 145 to the left, creating a wave in the water that has filled oscillating wash bath 14 through openings 148. In FIG. 14*b*, lightweight spheres 141 are equally distributed between the right and left halves of oscillating wash bath 14 which is in a state of temporary equilibrium. In FIG. 14*c*, the lightweight spheres 141 occupy the entire left half of cylindrical tube 140 and water completely fills the remaining half. Because of the greater weight of the water in the right half of cylindrical tube 140, oscillating wash bath 14 is tilted on fulcrum 145 to the right, creating another wave in the water filling oscillating wash bath 14, although in the opposite direction.

Figure 12:
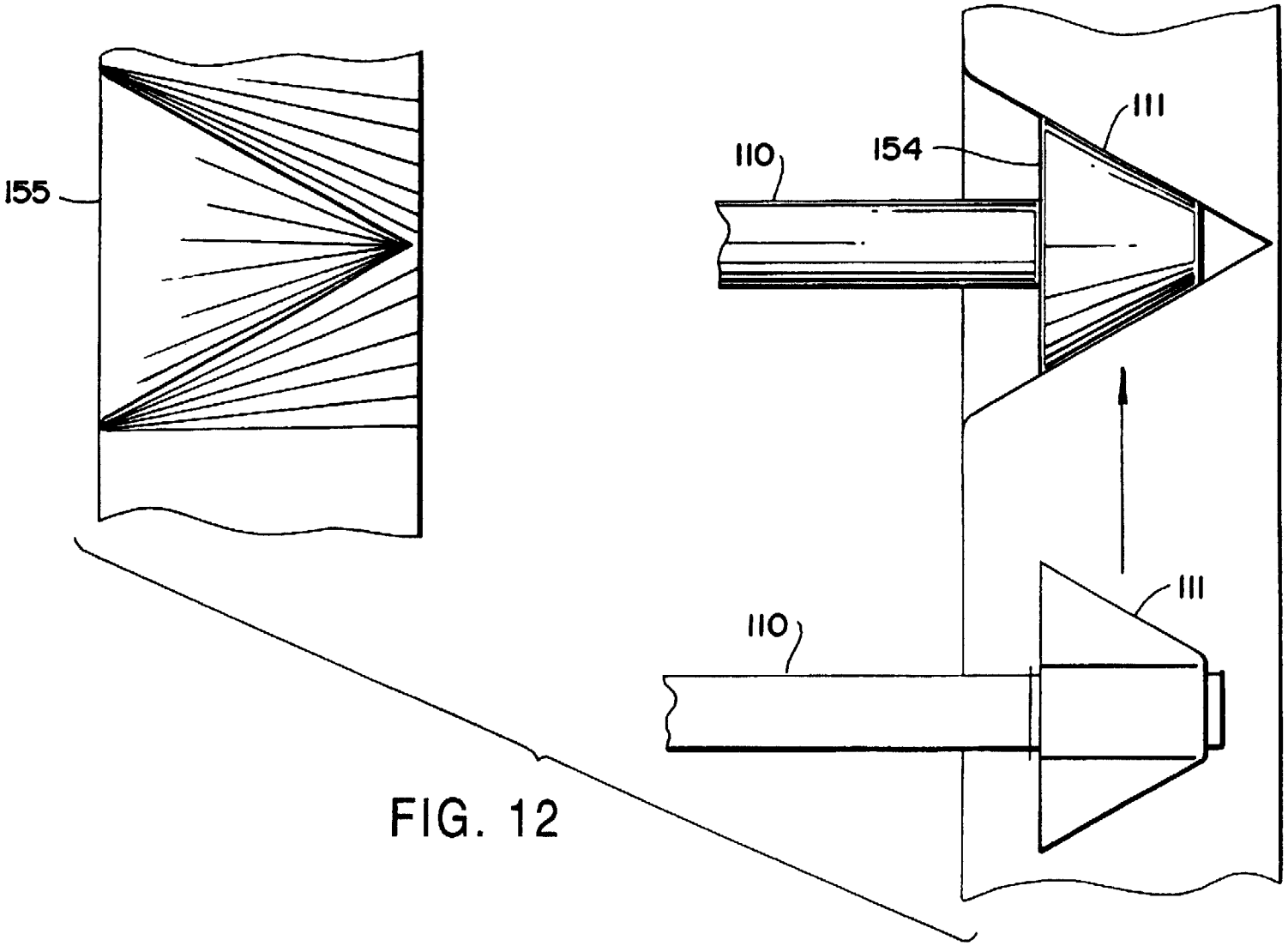
FIG. 12 is a schematic illustration of the conical wheel of the chemical processing trays and wheel tracks illustrating the wheel rolling down to the next level with the triangular stopper is removed.

The mobility of chemical processing trays 11, 12, and 13, in addition to providing a system by which prints may be developed inside corrugated sink housing 10, advantageously allows chemical processing trays 11, 12 and 13 to be emptied and cleaned without being removed from corrugated sink housing 10. Each corrugated groove in the side wall of corrugated sink housing 10 does not terminate at end wall 17 but extends in a 180° semi-circular bend 156 to the corrugated groove below. As shown in FIGS. 10 and 12, triangular apertures 155 in each corrugated groove provides a path for conical wheels 111 to travel to the corrugated groove below. During print processing, the chemical processing trays are prevented from inadvertently moving to the corrugated groove below by triangular inserts 154 blocking triangular apertures 155. Conical inserts 154 are then advantageously removed after print processing has been completed when chemical processing trays 11, 12 and 13 should be cleaned.

Figure 11:
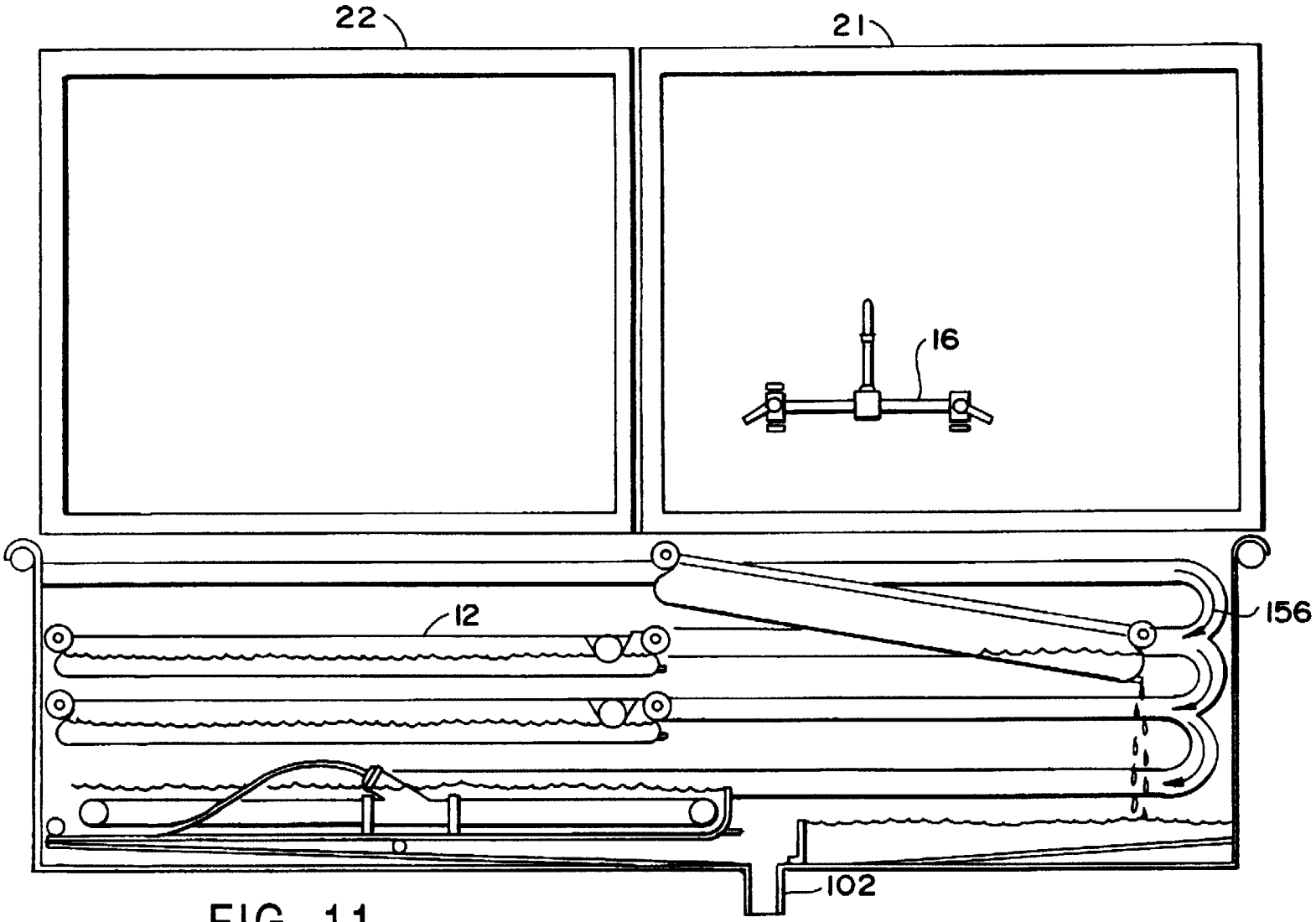
FIG. 11 is a partial cross-sectional front view of the photographic processing apparatus of FIG. 2 taken along line B—B illustrating a chemical processing tray angled downward to transfer chemicals from the tray into the basin area.

Referring now to FIG. 11, chemical processing tray 11 can be angled downward when triangular inserts 154 are removed and the end of the processing tray is rolled to the corrugated groove below. If desired, a greater angle may be achieved by rolling the end of chemical processing tray 11 down one or two more grooves further down. Advantageously, drain outlet 112 may be opened allowing the developer in chemical processing tray 11 to flow into basin area 15. This process can then be repeated for chemical processing trays 12 and 13. Angling chemical processing tray 11 downward to the furthest possible extent provides an optimal surface for removing excess water from the prints before placing them in drying racks 29.

Figure 21:
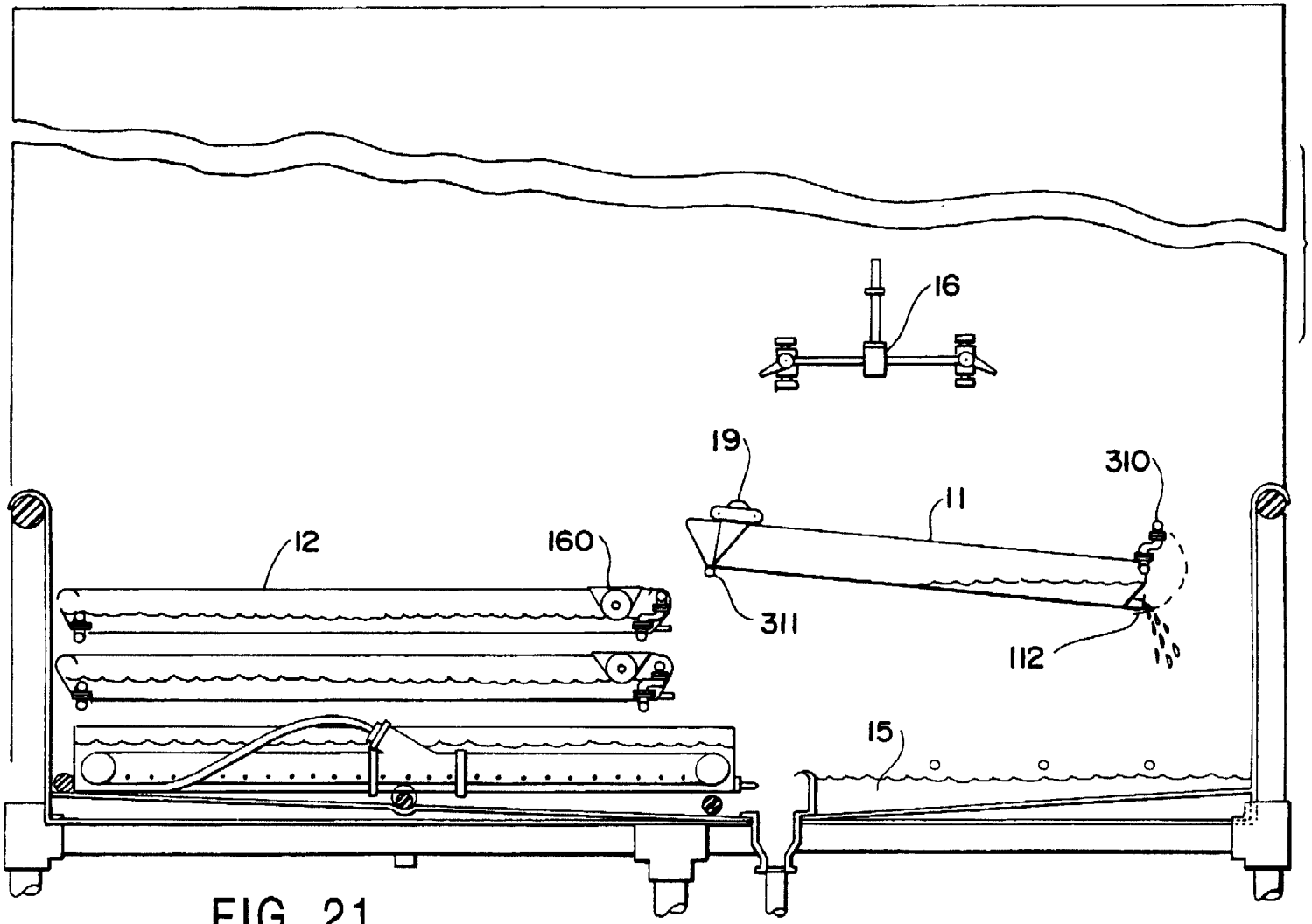
FIG. 21 is a partially sectional side view taken along line B—B of FIG. 2 illustrating an alternative implementation of the chemical processing trays.
Figure 22:
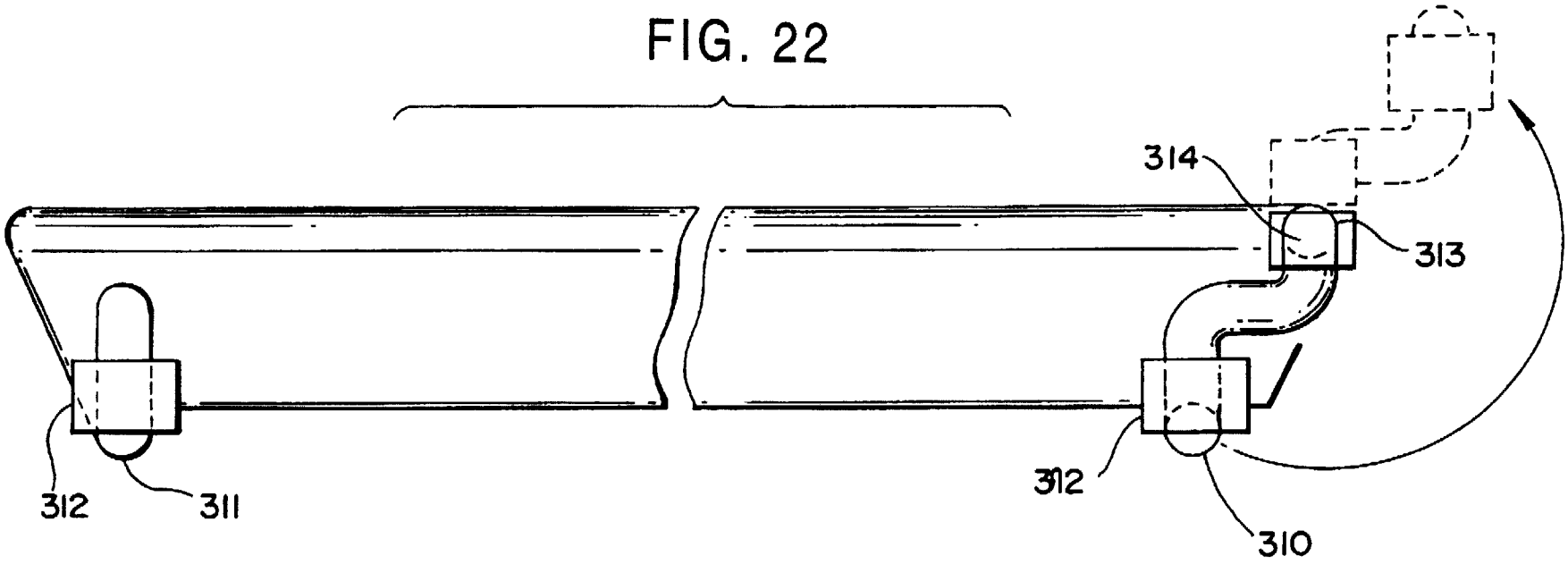
FIG. 22 is a cross-sectional side view illustrating the rotating axle of the chemical processing tray shown in FIG. 21.
Figure 23:
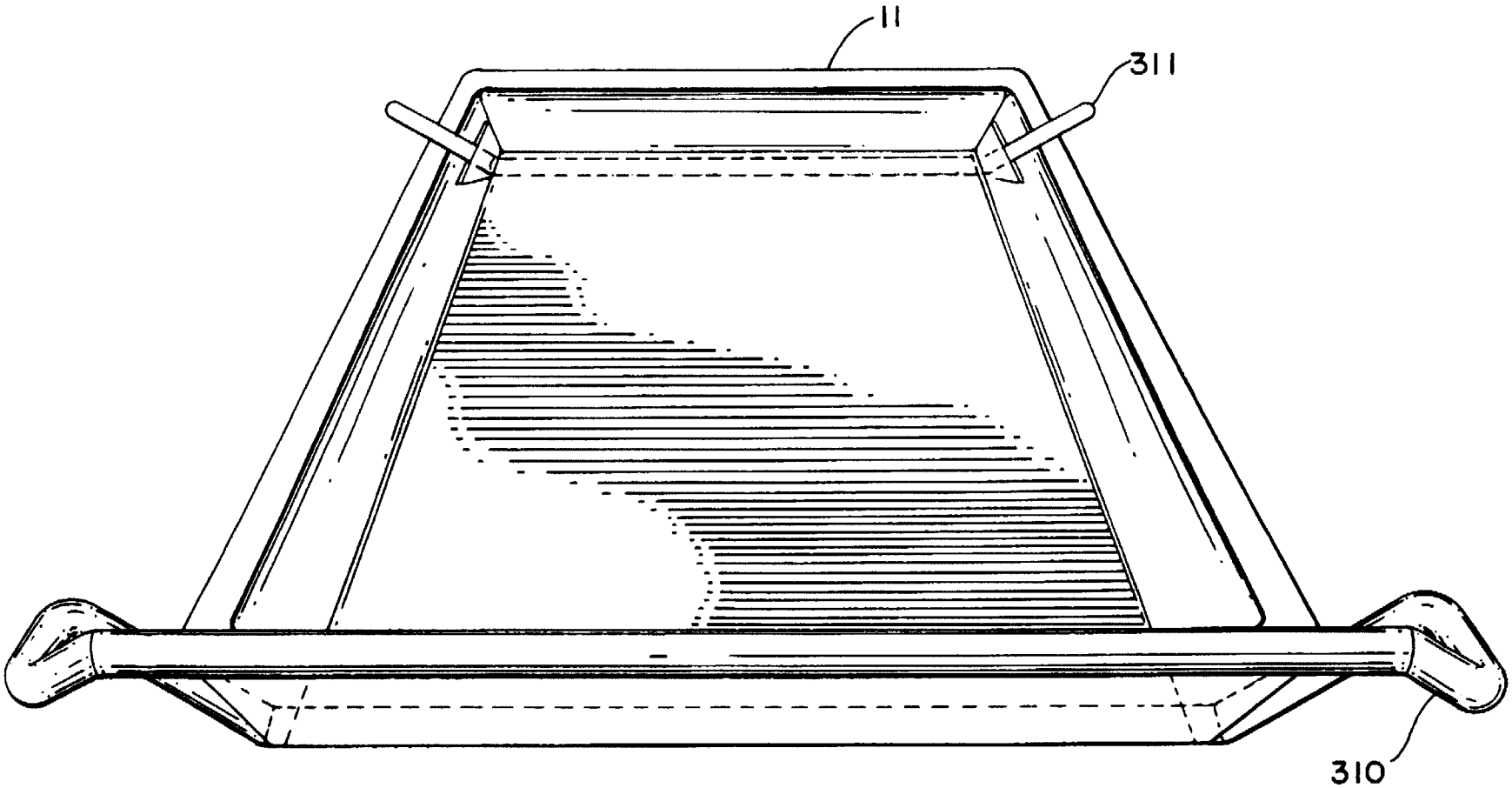
FIG. 23 is a perspective top view showing the rotating axle of the chemical processing tray shown in FIGS. 21–22.

Referring now to FIGS. 21 and 22, an alternative embodiment of the present invention is illustrated wherein the chemical processing trays may be angled downward using rotating axle 310. Referring now to FIGS. 22 and 23, stationary axle 311 is fixedly mounted to the bottom of chemical processing tray 11 whereas rotating axle 310 is pivotally mounted to the top. Round wheels 312 are rotatably affixed to stationary axle 311 and rotating axle 310. Rotating axle 310 is pivotally affixed to the top of chemical processing tray 11 at pivot 314. Wheel 312 remains generally stationary in the corrugated groove as chemical processing tray 11 is angled downward. Advantageously, the downward travel of chemical processing tray 11 is limited by cylinder 313 which engages the top of chemical processing tray 11 when rotating axle 310 is fully rotated.

Figure 26A:
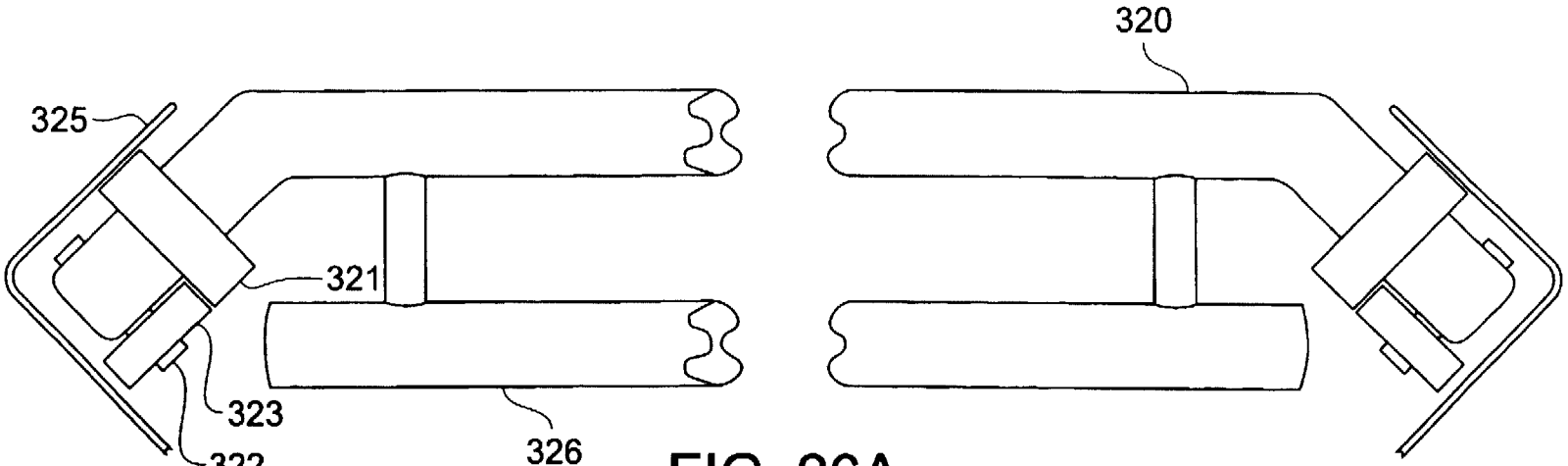
FIG. 26*a* is a partially sectional side view showing an alternative embodiment of the rotating axle of a chemical processing tray in the corrugated sink housing when the tray is angled for draining.
Figure 26:
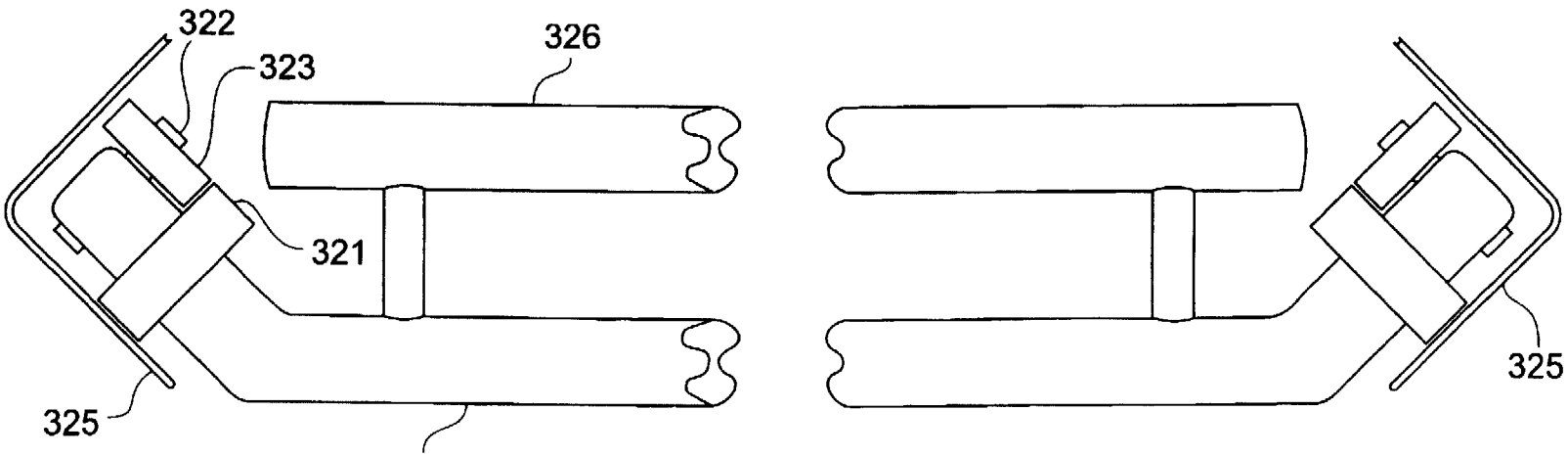
FIG. 26 is a partially sectional side view showing an alternative embodiment of the rotating axle of a chemical processing tray in the corrugated sink housing when the tray is level for processing.
Figure 27:
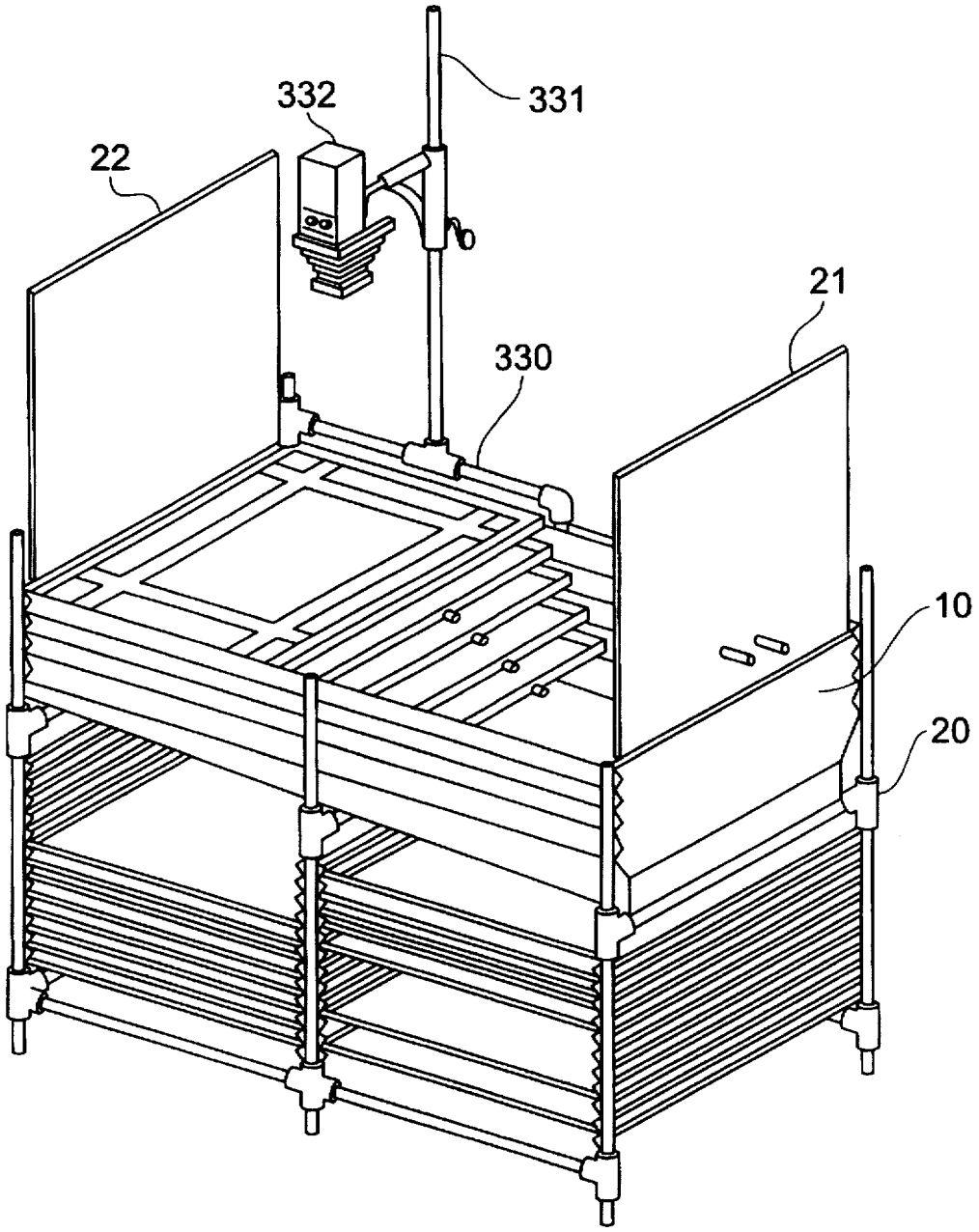
FIG. 27 is a perspective front view of the photographic processing apparatus of the present invention with an enlarger and horizontal print easel.

Referring now to FIGS. 25 and 26, other alternative embodiments of the present invention are illustrated wherein the chemical processing trays may be angled downward using rotating axles. Referring to FIG. 25, rotating axle 320 is pivotally mounted to chemical processing tray 11 and round wheels 321 are rotatably affixed to rotating axle 320. As shown, round wheels 321 are in contact with the bottom surface of horizontal groove 325 when the chemical processing tray is not tilted. Axles 322 are perpendicular to rotating axle 320 and are positioned between round wheel 321 and the end of rotating axle 320 on either side. Round wheels 323 are rotatably affixed to perpendicular axles 322 and are in contact with the top surface of horizontal groove 325 when the chemical processing tray is not tilted. Referring to the alternative embodiment of FIG. 26, rotating axle 320 may be affixed to tray rod 326. In this embodiment, tray rod 326 is rotatably mounted to chemical processing tray 11. Referring to FIG. 27, the photographic processing system of the present invention may be adapted for the production of photographic prints using a standard print enlarger. In the preferred embodiment shown, covers 21 and 22 are hingedly affixed to the right and left side walls of corrugated sink housing 10 respectively. Print easel 330 is placed over corrugated sink housing 10 and vertical enlarger support 331 is affixed to tubular support structure 20. Print enlarger 332 may then be vertically positioned in accordance with conventional darkroom techniques for producing photographic prints.

Figure 28:
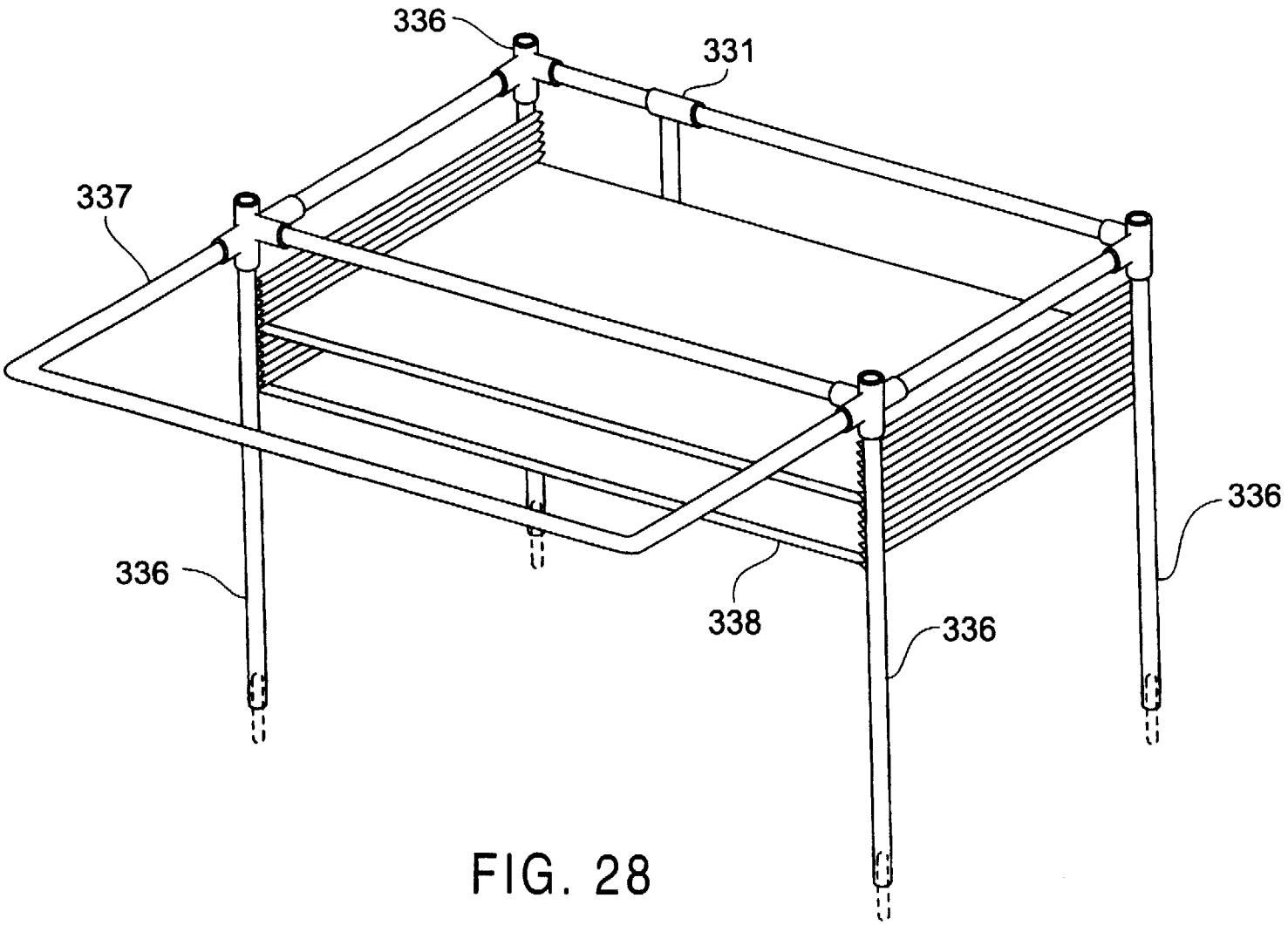
FIG. 28 is a perspective front view of the vertical extension of the tubular support structure of the present invention.

Referring now to FIG. 28, the tubular support structure of the present invention may be extended as described in reference to FIG. 5. Vertical supports 336 may be inserted into apertures 230 in order to vertically extend the tubular support structure 20. As shown, vertical enlarger support 332 may also be stabilized. Tubular support structure 20 is then extended horizontally by generally rectangular support 337 which provides a curtain hanging apparatus. Additional shelving and storage area 338 may also be provided.

Figure 29:
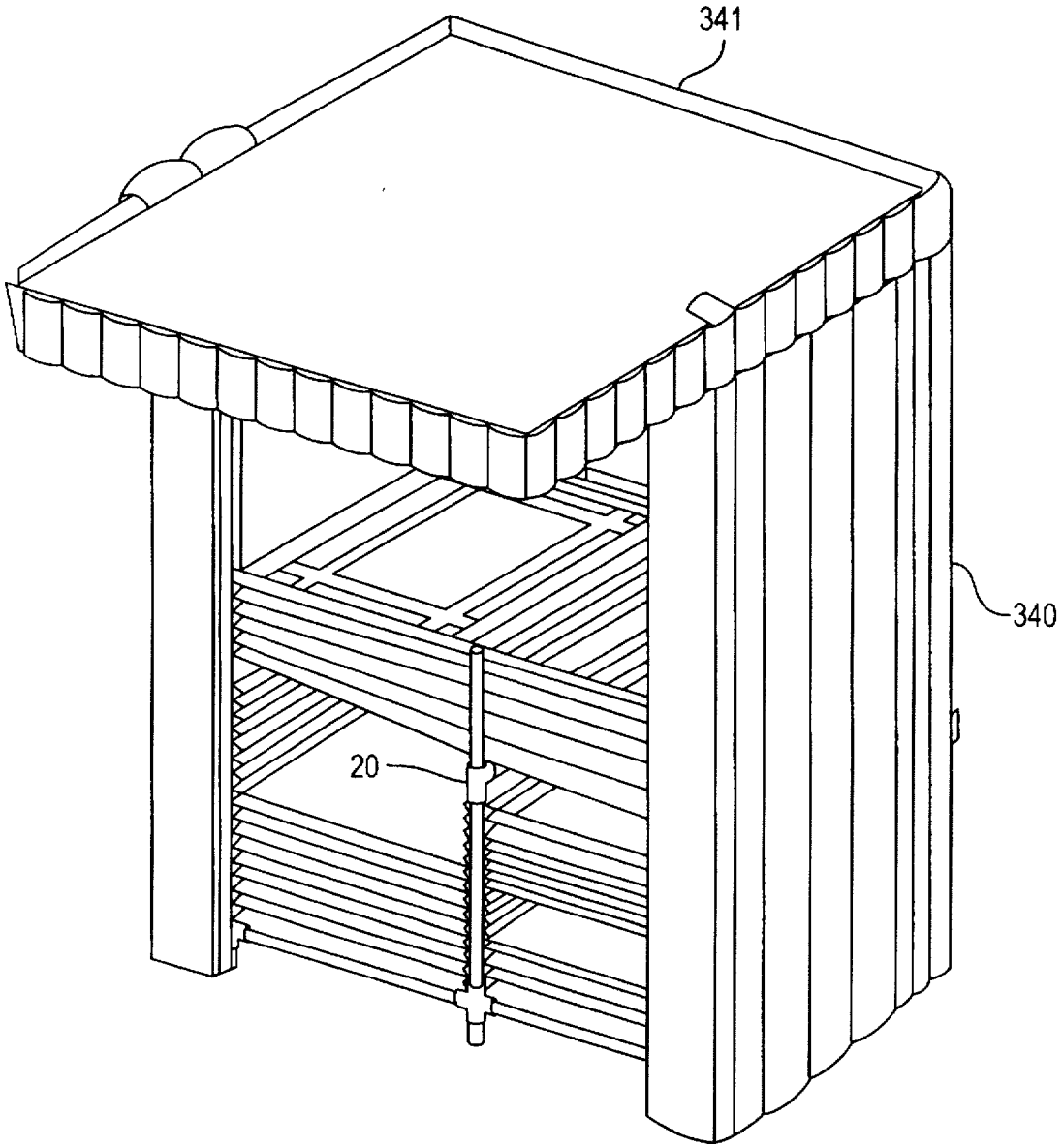
FIG. 29 is a perspective front view of the light-blocking canopy apparatus of the present invention.

Referring now to FIG. 29, the photographic processing system of the present invention may be used in a lighted room by attaching curtains 340 and canopy 341 to extended tubular support structure 20. This eliminates the need for a dedicated dark room as well as enabling several photographic processing systems to be used simultaneously in, for example, a class room environment.

Figure 30:
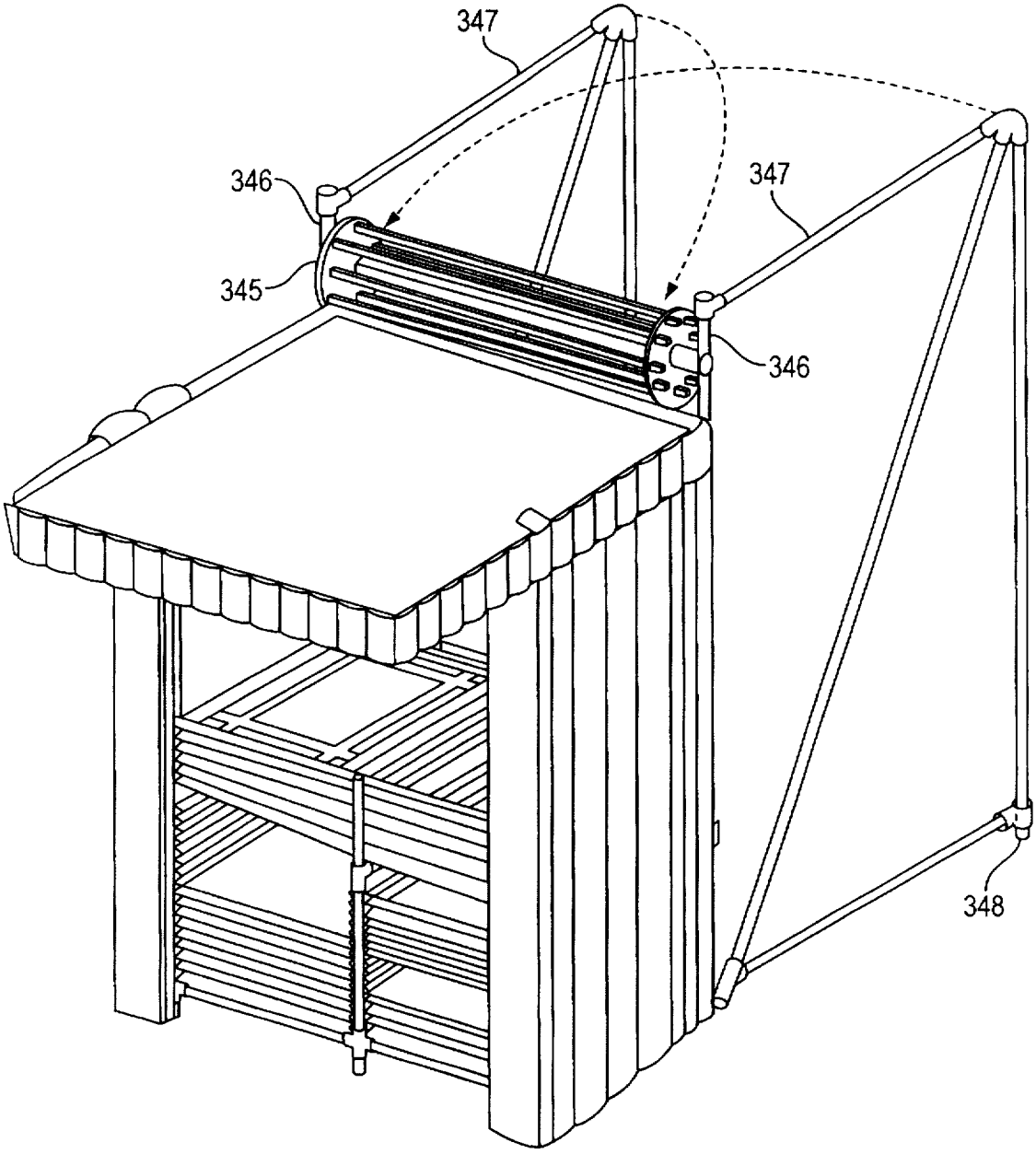
FIG. 30 is a perspective front view of the set and light supports apparatus of the present invention.

Referring now to FIG. 30, the photographic processing system of the present invention may be further enhanced for studio use by the attachment of a set support and light supports. As shown in FIG. 30, the set support is formed by spool 345 rotatably affixed to rotatable vertical tubular extensions 346. One or more backdrops may be affixed to spool 345 to provide sets for photographs. Horizontal tubular extensions 347 can be used as light supports, advantageously enabling a photographer to position lights above a subject. Moreover, wheels 348 enable a photographer to easily move the lights, as well as providing for compact storage when the set and light supports are not in use.

Figure 32:
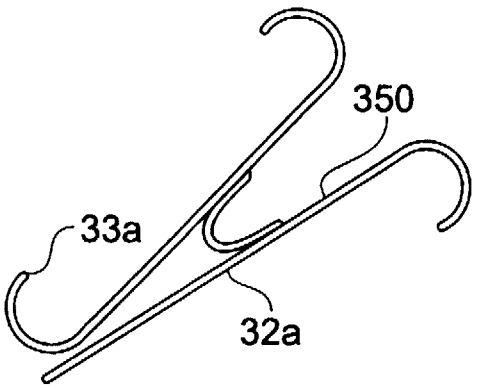
FIG. 32 is a cross-sectional side view taken along line G—G of FIG. 31 illustrating the print gripper of FIG. 31.
Figure 31:
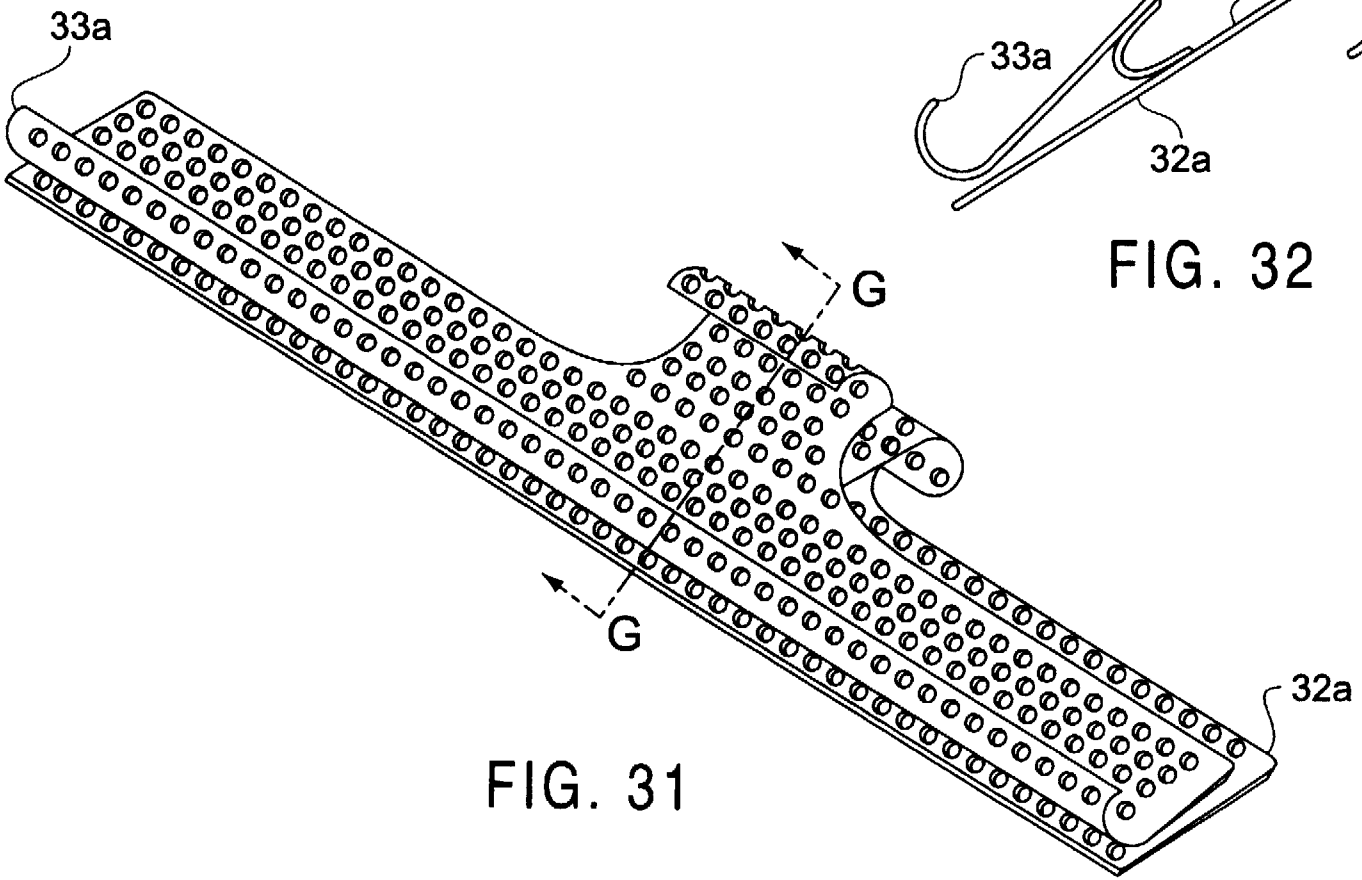
FIG. 31 is a perspective top view showing an alternative embodiment of the print gripper used to transport prints.

Referring now to FIGS. 31 and 32, an alternative embodiment of print gripper 30 is illustrated. As shown, planar surface **32*a* and curvilinear surface 33*a* are advantageously perforated to make the print gripper more manageable. Referring now to FIG. 32, planar surface 32*a* and curvilinear surface 33*a* are connected by spring clip 350 affixed to the interior facing sides of planar surface 32*a* and curvilinear surface 33*a***. The print gripper is preferably constructed of stainless steel which, because the bends of the gripping surfaces maintain the needed form, may be built using light gauge material.

Figure 33:
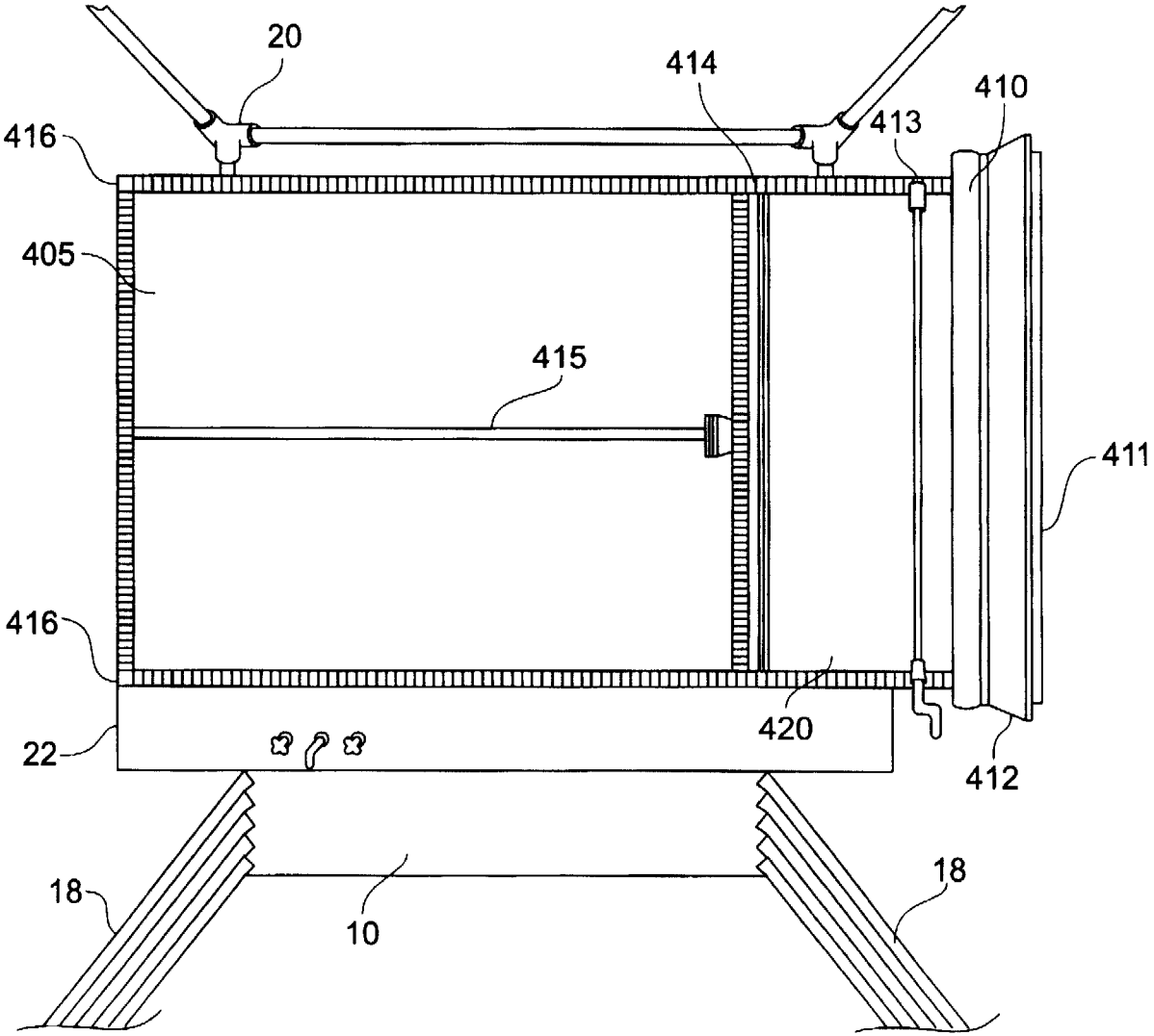
FIG. 33 is a perspective front view of the mural printing easel.

The photographic processing system of the present invention may also be adapted for use as a mural printing easel as shown in FIG. 33. Similar to the alternative embodiment of the present invention shown in FIG. 27, top covers 21 and 22 are hingedly affixed to the right and left side walls of corrugated sink housing 10. Mural printing easel 405 is disposed on the bottom surface of top cover 21. A roll of photographic paper is disposed on paper spool 410 which is contained in rectangular paper chamber 411 fixedly mounted to the side of mural printing easel 405. When a mural is not being printed, paper chamber cover 411 is closed to prevent the photographic paper disposed on paper spool 410 from being exposed to light. When a mural is to be printed, as shown in FIG. 33, paper chamber cover 411 is opened to provide access to photographic paper 420. Photographic paper 420 is rolled under paper roller 413 and gripped by paper gripper 414. Paper gripper 414 advantageously interfits in paper gripper track 415 which linearly constrains the movement of paper gripper 414. In the preferred embodiment, the ends of paper gripper 414 cooperatively interfit with paper guides 416. By moving paper gripper 414 a desired length of photographic paper may be rolled out from paper spool 410. Once a desired length has been rolled out, the paper is cut and paper chamber cover 411 is closed.

Photographic paper 420 is advantageously held flat by paper gripper 414 and paper roller 413 during print exposure. By positioning the photographic paper vertically instead of horizontally, the enlarger may be moved further away from the print paper than is possible using a conventional dark room, thereby making it possible to produce large mural prints without expensive facilities.

In view of the foregoing description of my invention, it will be recognized by those skilled in the art that the disclosed embodiment may be changed and modified in various ways without departing from the scope of the invention. For example, the print sponge may be modified to include counter-rotating dual sponges that simultaneously sponge off the print being developed while transferring it to the next chemical processing tray or film development drums may be rolled using the corrugated grooves. Additionally, each tray could include thermostatically coupled heating elements to ensure isothermic processing chemicals or the axle configurations of the processing trays could be modified to allow a tray end to be tilted downward without moving to a lower groove.

What is claimed is:

1. A photographic processing apparatus comprising:

a generally rectangular housing having first and second generally parallel side walls, first and second end walls and a bottom side;

a plurality of chemical processing trays having first and second side walls, first and second end walls, and a bottom;

said chemical processing trays being slidably mounted to said generally parallel side walls of said generally rectangular housing for longitudinal movement parallel to said generally parallel side walls of said generally rectangular housing;

first and second covers having inner and outer surfaces pivotally mounted to said first and second end walls of said generally rectangular housing for enclosure thereof;

a light-blocking paper chamber affixed to said first cover for holding a roll of photographic paper;

a paper roller disposed above said inner surface of said first cover and adjacent said light-blocking paper chamber for rolling said photographic paper;

a paper gripper disposed on said inner surface of said first cover adjacent said paper roller for transporting said photographic paper across said inner surface; and a photographic print enlarger disposed on said inner surface of said second cover for producing photographic prints on said photographic paper disposed on said inside surface of said first cover.

2. A photographic processing apparatus comprising:

a generally rectangular housing having first and second side walls, first and second end walls and a bottom side; and a plurality of chemical processing trays having third and fourth side walls, third and fourth end walls, and a bottom;

said plurality of chemical processing trays being slidably mounted to said first and second side walls for longitudinal movement parallel to said first and second side walls;

said plurality of chemical processing trays each having an aperture in one of said end walls for expelling fluids.

3. The photographic processing apparatus of claim 2 wherein said first and second side walls are horizontally corrugated, said corrugations forming a plurality of grooves, with each groove including an upper surface and a lower surface, and said chemical processing trays including first and second axles having wheels for engaging the corrugations.

4. The photographic processing apparatus of claim 3 wherein said first axles are fixedly mounted to said chemical processing trays, and each of said chemical processing trays is pivotable about said second axle.

5. The photographic processing apparatus of claim 4, further including a wheel rotatably coupled to each end of each of said axles for engaging the first and second side walls.

6. The apparatus of claim 4 wherein each end of said second axles has a first wheel and a second wheel, the first wheel being rotatably coupled to the axle and in contact with the bottom surface of one of the plurality of grooves when the tray is untilted, the second wheel lying in a plane perpendicular to the first wheel and being disposed in contact with the top surface of said groove when the tray is untilted.

7. The photographic processing apparatus of claim 2, further comprising:

a housing support structure having a plurality of interconnecting members, said structure defining two lower interior regions with a common interior side, opposing exterior sides, adjacent top and bottom sides, and an upper rectangular region, said structure frictionally interfitting and supporting said housing;

a plurality of vertical supports each connected to said structure for vertically extending said structure;

a horizontal support connected to said vertical supports;

a canopy attached to said horizontal support; and a slidable curtain, the upper edge of which is slidably attached to said horizontal support.

8. The photographic processing apparatus of claim 7, further comprising:

first and a second vertical extensions removably coupled to first and second vertical supports, and a set support wheel rotatably affixed to said first and second vertical extensions, said set support wheel having an axis of rotation perpendicular to said first and second vertical extensions.

9. The photographic processing apparatus of claim 8, further comprising a light support structure including a top member coupled to a vertical extension, a bottom member coupled to a vertical support, and a side member coupled to said top member and said bottom member.

10. The photographic processing apparatus of claim 9 wherein said light support structure is pivotable about said vertical extension, and further comprises a wheel coupled to said bottom member.

11. The photographic processing apparatus of claim 10, further comprising one or more light fixtures removably attached to said light support structure.

12. A photographic processing apparatus comprising:

a generally rectangular housing having first and second generally parallel side walls, first and second end walls and a bottom side:

a plurality of chemical processing trays having third and fourth side walls, third and fourth end walls, and a bottom, said plurality of chemical processing trays being slidably mounted to said first and second side walls for longitudinal movement;

a print gripper having a generally planar first part coupled to a generally planar second part, each part having a series of perforations and having a width at least as wide as a print under development, a handle end and a gripping end;

said gripping end of said first part having a lip protruding at an angle from the plane thereof and said gripping end of said second part being substantially planar and frictionally engaging said protruding lip of said first part for gripping the print therebetween.

13. A photographic processing apparatus comprising:

a generally rectangular housing having first and second generally parallel side walls, first and second end walls and a bottom side;

a plurality of chemical processing trays having third and fourth side walls, third and fourth end walls, and a bottom, said plurality of chemical processing trays each containing at least one aperture for expelling fluids therefrom and being slidably mounted to said first and second side walls for longitudinal movement:

a print gripper having a generally planar first part coupled to a generally planar second part, each part having a width at least as wide as a print under development, a handle end and a gripping end;

said gripping end of said first part having a lip protruding at an angle from the plane thereof and said gripping end of said second part being substantially planar and frictionally engaging said protruding lip of said first part for gripping the print therebetween.

14. A print gripper for gripping a print under development comprising:

a generally planar first part;

a generally planar second part compressively coupled to the first part, each part having a width at least as wide as the print under development;

a handle end; and a gripping end, said gripping end of said first part having a lip protruding at an angle from the plane thereof, and said gripping end of said second part frictionally engaging said protruding lip of said first part for gripping the print therebetween.

15. The print gripper of claim 14, wherein at least one of said first part and said second part contains a series of perforations.

16. A photographic processing apparatus comprising:

a generally rectangular housing having first and second generally parallel side walls, first and second end walls and a bottom side;

a plurality of chemical processing trays having third and fourth side walls, third and fourth end walls, and a bottom, said plurality of chemical processing trays being slidable along said first and second side walls for longitudinal movement parallel to said first and second side walls;

a cover coupled to an end wall, said cover having an inner and outer surface;

and a print enlarger device slidably mounted to a rod coupled to said apparatus.

17. The photographic processing apparatus of claim 16, further comprising:

a printing easel disposed on the inner surface of said cover;

a photographic paper chamber disposed on said printing easel for holding a roll of photographic paper on a spool;

a print gripper disposed on said inner surface of said first cover for transporting said paper in a horizontal direction.

18. The photographic processing apparatus of claim 17 wherein said photographic paper chamber comprises a pivotable cover to selectively prevent the photographic paper from being exposed to light rays.

19. The photographic processing apparatus of claim 18, further comprising:

paper guides disposed along the edge of said printing easel;

said print gripper being cooperatively interfit with said paper guides to linearly constrain movement to a horizontal direction.

* * * * *

UNITED STATES PATENT AND TRADEMARK OFFICE

CERTIFICATE OF CORRECTION

PATENT NO : 5,778,273

DATED : JULY 17, 1998

INVENTOR(S) : SHLOMO BEN-YAACOV

It is certified that error appears in the above-identified patent and that said Letters Patent is hereby corrected as shown below:

On the title page:Item [54] and Column 1, line 3, the title of the invention "Photographic Processing System" is corrected to read -- Photographic Studio System --.

Signed and Sealed this

Thirteenth Day of October 1998

*Attest:*

*Attesting Officer*

Bruce Lehman

BRUCE LEHMAN

*Commissioner of Patents and Trademarks*